United States Patent [19]

Sullivan et al.

[11] Patent Number: 5,029,558

[45] Date of Patent: Jul. 9, 1991

[54] ROTARY VEE ENGINE

[75] Inventors: Robert W. Sullivan, Snyder; Tommie J. Holder, Mountain Park; Max F. Buchanan, Roosevelt, all of Okla.

[73] Assignee: Sullivan Engine Works, Snyder, Okla.

[21] Appl. No.: 373,208

[22] Filed: Jun. 28, 1989

Related U.S. Application Data

[62] Division of Ser. No. 151,657, Feb. 3, 1988, Pat. No. 4,867,107.

[51] Int. Cl.[5] ..... F02B 57/06

[52] U.S. Cl. ..... 123/43 A

[58] Field of Search ..... 91/500; 123/43 A, 43 AA

[56] References Cited

U.S. PATENT DOCUMENTS

| | | | |
|---|---|---|---|
| 3,830,208 | 8/1974 | Turner | 123/43 A |
| 3,902,468 | 9/1975 | Turner | 123/43 A |
| 3,905,338 | 9/1975 | Turner | 123/43 A |
| 3,973,531 | 8/1976 | Turner | 123/43 A |
| 4,060,060 | 11/1977 | Turner | 123/43 A |
| 4,648,358 | 3/1987 | Sullivan et al. | 123/43 A |

*Primary Examiner*—Michael Koczo

*Attorney, Agent, or Firm*—Willian Brinks Olds Hofer Gilson & Lione

[57] ABSTRACT

A bent axis rotary piston engine which includes features improving its operational characteristics. The engine provides the capability of dual output power, improved cooling and gas flow through the engine, supercharging and improved scavenging of the exhaust. The engine also includes an oiling system, an improved bent axis piston design, and a rotary valve system provided by the pistons and cylinders. The engine is also adapted to incorporate auxiliary equipment such as a starter and magneto system, and an electrical power generator. Other features are disclosed.

15 Claims, 15 Drawing Sheets

FIG. 1
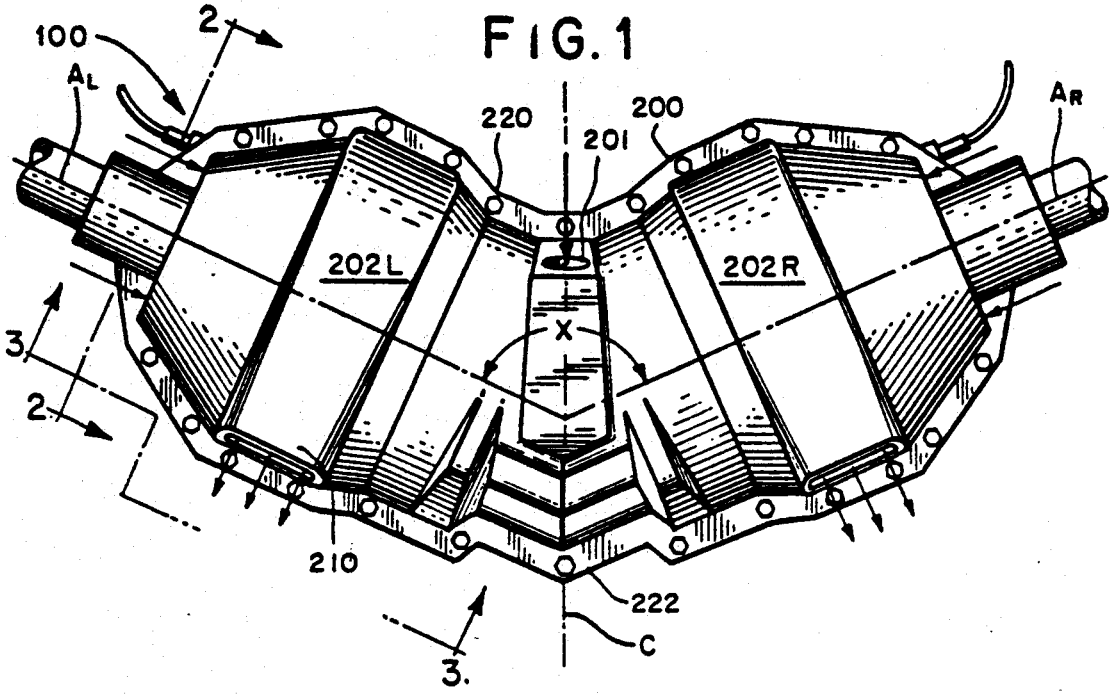
FIG. 2
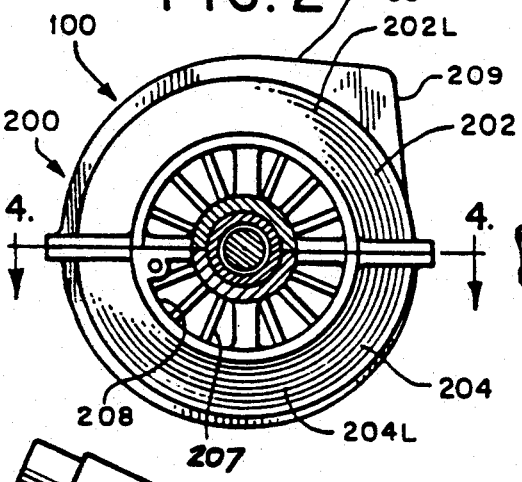
FIG. 3
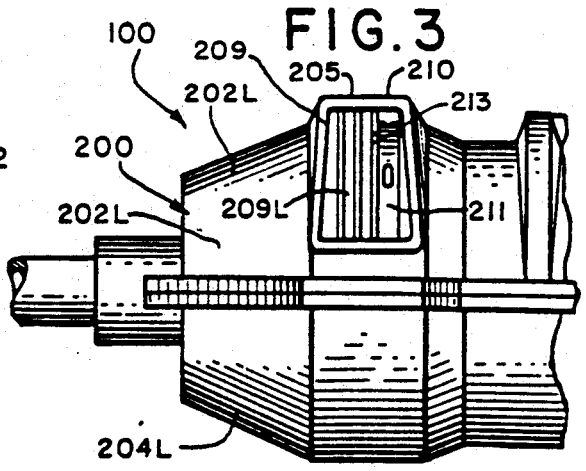
FIG. 7
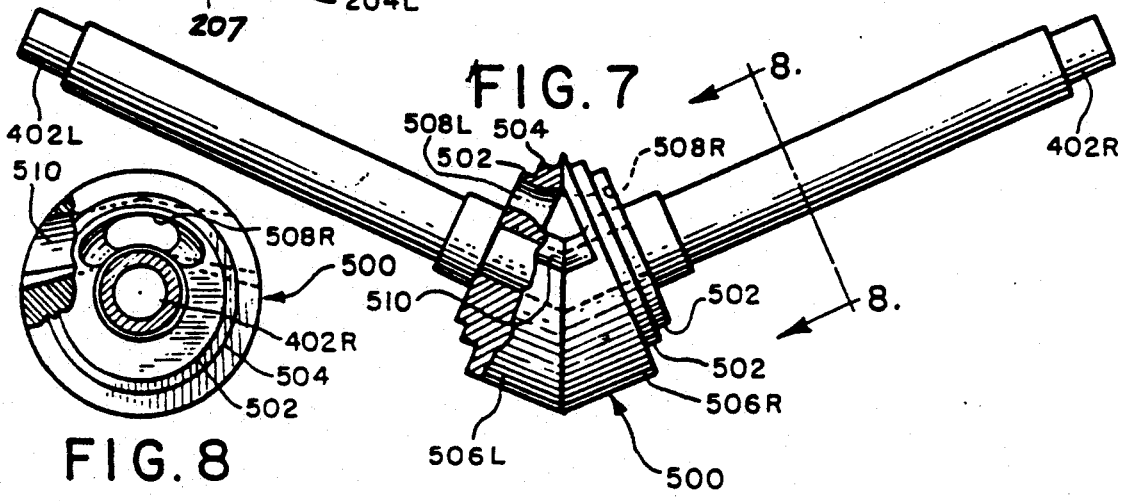
FIG. 8

FIG. 20
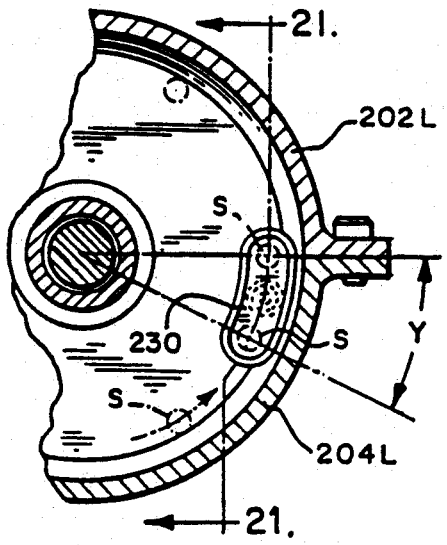
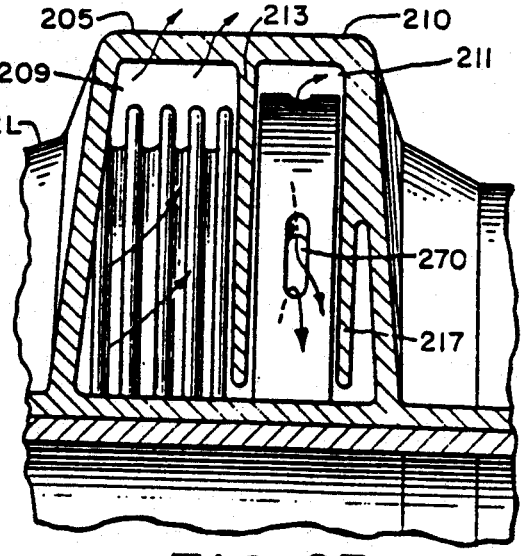
FIG. 23
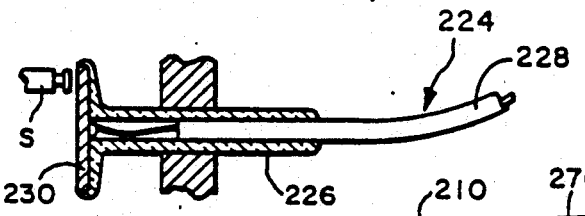
FIG. 21
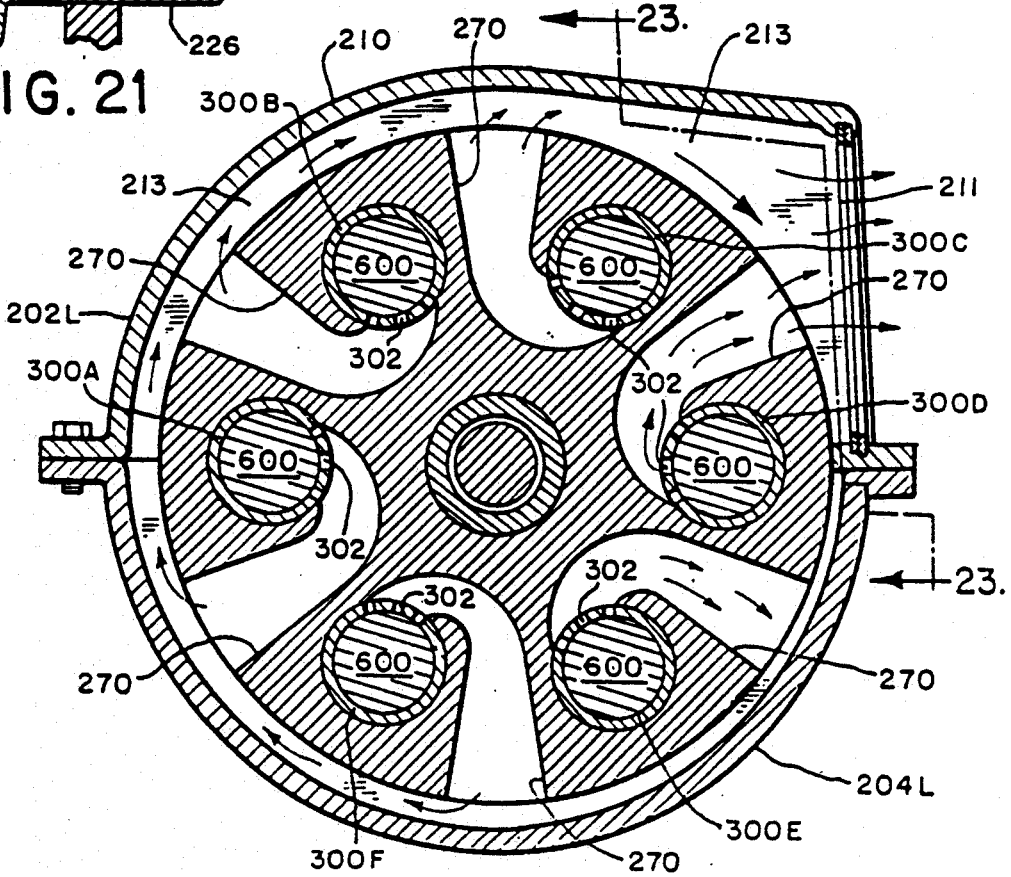
FIG. 22

ROTARY VEE ENGINE

This is a division of application Ser. No. 151,657, filed Feb. 3, 1988, Pat. No. 4,867,107.

BACKGROUND OF THE INVENTION

The present invention relates to improvements in internal combustion engines and, more particularly, to improvements to internal combustion engines of the rotary vee type, such as described in U.S. Pat. No. 4,648,358, issued Mar. 10, 1987 to the same inventors and entitled Rotary Vee Engine.

BRIEF DESCRIPTION OF THE PRIOR ART

In a conventional internal combustion engine, pistons reciprocate in cylinders formed in a stationary cylinder block and combustion within the cylinders is timed to cause the pistons to turn a crank shaft from which power is delivered from the engine. While engines of this type are the most common type of engine currently in use, it has been recognized that such engines are inherently subject to a problem that lowers the efficiency of the engine. In particular, the reciprocation of the piston involves a sequence of accelerations of each piston from rest followed by a deceleration of each piston to rest. The work that is done on the pistons during these accelerations and decelerations is not recovered so that the energy, provided by the fuel used in the engine, necessary to perform this work results in an overall loss of efficiency of the engine.

Because of this loss of efficiency in a conventional engine, other types of engines have been considered as possible candidates for replacing the conventional engine. One such type of engine is the rotary vee engine which includes two cylinder blocks mounted in a housing for rotation about intersecting axes that are angled toward one side of the engine. Cylinders are bored into each of the cylinder blocks from the end which faces the other cylinder block and the engine is further comprised of a plurality of pistons, angled in the same manner that the rotation axes of the cylinder blocks are angled, so that one portion of each piston can be extended into a cylinder in one cylinder block and another portion of the piston can be extended into a corresponding cylinder in the other cylinder block. Thus, as the cylinder blocks rotate, the pistons orbit about the rotation axes of the cylinder blocks to vary the free volumes of the cylinders in the cylinder blocks. This is, when a piston, is on the side of the engine away from which the rotational axes of the cylinder blocks are angled, only a small part of each piston will extend into each of the cylinders, in the two cylinder blocks, in which the piston is mounted, while major portions of each piston are disposed in the two cylinders in the two cylinder blocks when the piston is moved to a position at the side of the engine toward which the two rotational axes of the cylinder blocks are angled. Thus, compression and expansion of gases in the cylinders can take place with a continuous motion of both the cylinder blocks and the pistons to eliminate the loss of efficiency of a conventional engine that has been described above.

In practice, the rotary vee engine has not lived up to the expectations that inventors have had for such engines. Because of the angled disposition of the rotating cylinder blocks and the firing of each cylinder at one side of the cylinder block, forces which tend to spread the two cylinder blocks into a straight line; that is, out of the vee configuration are exerted on the cylinder blocks. Such forces result in drag between the pistons and cylinder blocks that interferes with the operation and efficiency of the engine. Because of this problem, rotary vee engines have not enjoyed much success despite the promise that they hold and, indeed, it has been found that an engine constructed in the rotary vee configuration will often not even operate because of these problems that are inherent in the rotary vee configuration.

The rotary vee engine described in Pat. No. 4,648,358 solves the basic problems that have plagued the rotary vee engine in the past and provides the operability that is necessary to exploit the advantages that are offered by engines of this type As set forth in Pat. No. 4,648,358, an operable rotary vee engine can be constructed by including in the engine an angled support shaft having portions that extend through the cylinder blocks along the axes of rotation of the cylinder blocks and having ends that are both supported by a housing in which the cylinder blocks are disposed. Bearings on the support shaft are located near each end of each cylinder block to transmit the forces that tend to spread the cylinder blocks out of the rotary vee configuration to the housing and thereby avoid any misalignment of the cylinder blocks that can, experience has shown, prevent the engine from operating. Other aspects of the engine which substantially improve on prior rotary engine designs are also described in Pat. No. 4,648,358.

SUMMARY OF THE INVENTION

Continuing developments in the rotary engine disclosed in Pat. No. 4,648,358 have resulted in substantial modifications and improvements which enhance the utilization and operational characteristics of the engine. One improvement of the present invention is the redesign of engine components to provide the engine with dual output shafts without diminishing the strength or efficiency of the engine. In another aspect of the invention, the components of the engine have been redesigned to improve the sealing characteristics of the engine. Engine efficiency is enhanced by these sealing features which maintain the necessary separation between the cooling air, air/fuel mixture and exhaust gases in the engine. Provisions are also made for the selective cooling of the exhaust gases by the cooling air, for environments where a substantially reduced temperature of the exhaust gases provides substantial operational advantages. Improvements in the design and operation of the spark ignition system have also been accomplished.

Further developments have provided the rotary vee engine with auxiliary support systems which are integrated in the engine in a fashion which takes advantage of the inherent operational characteristics of rotary vee engines. In this regard, a low pressure oil system is provided in the engine which utilizes the centrifugal forces present in rotary vee engines to distribute lubricating oil to the necessary engine components in a simple and efficient manner. An engine starter system is integrated into the rotary engine to eliminate the need for auxiliary starting equipment or a conventional fly wheel. The improved engine design also incorporates an integrated magneto system which can be used to energize the engine ignition system.

Other developments have integrated into the rotary vee engine a compact auxiliary electrical power generating system which can be utilized to recharge the battery and energize other electrical components used to operate the engine. Alternatively, the auxiliary power generating system incorporated in the engine can be adapted to generate electrical power for driving auxiliary equipment without detracting from the operational efficiency of the rotary vee engine.

Another aspect of the present invention relates to improved piston design. As set forth above, the natural forces present in rotary vee engines create a substantial force load on the pistons in a direction transverse to the reciprocation of the pistons in the engine. For example, in some environments, and under certain loading conditions, it has been found that these forces can be sufficiently substantial to cause the orbiting pistons to experience inertial loads in the range of a 2500 g force at 5000 rpm. Such a substantial load can create undesirable increased friction between the pistons and the cylinder, which reciprocate with respect to each other. This substantial force tends to break down any lubricating film barrier between the piston and the cylinder. This invention provides pistons for use in the rotary vee engine which substantially reduces these loading problems.

A very significant further aspect of the present invention relates to the improvements in engine valving and scavenging operations. In accordance with this invention, the engine components are arranged so that engine valving is controlled by a unique rotary valve provided on the operating end or piston head of each piston. This rotary valve is coordinated with the relative rotation of the piston in each cylinder, and with the porting of the engine, to control the flow of air/fuel mixture and exhaust gases through the engine. The rotary valve piston head of this invention eliminates complicated valve actuation control mechanisms incorporated in many engines of the prior art. The rotary valve piston heads also control the flow of gases through the engine so that the scavenging and operational efficiency of the engine are improved.

The porting and rotary valve systems of this invention are also integrated with an improved design for the engine air intake and exhaust manifolds. The improved manifolding recognizes and takes advantage of the centrifugal forces which are inherently applied to any gases flowing through a rotary vee engine The present manifolding system utilizes the differential effect of centrifugal forces on the relatively heavy air/fuel mixture and the relatively light exhaust gases to maintain the gases in a generally stratified condition in the cylinders to enhance scavenging. The disadvantageous admixture of air/fuel gases and exhaust gases caused by the swirling effect of centrifugal force on the gases in rotary vee engines having earlier porting, valving and manifolding designs has therefore been substantially reduced or overcome.

In general, the improved manifolding system cooperates with other engine components to supercharge the air/fuel mixture in an intake manifold with a combination of pressure and centrifugal forces. The intake manifolding is arranged to maintain this supercharged air/fuel mixture in a chamber portion of the manifold that is radially outward of each rotating piston and cylinder combination. The supercharged manifold pressure, aided by the centrifugal forces created by the continued rotation of the manifolds in the cylinder blocks, causes the relatively heavy air/fuel mixture to be rapidly charged into and maintained under pressure in this radial outward chamber portion of the manifold associated with each cylinder.

The rotary valving piston heads and porting system of the engine cooperate with the intake manifold to admit the air/fuel mixture at the selected time into the engine cylinders. In this aspect of the invention, the air/fuel mixture is charged into the cylinders through intake ports in a radially inward direction by the application of sufficient supercharged pressure on the air/fuel mixture to overcome the outwardly directed centrifugal forces being applied to the mixture. Centrifugal force continues to be applied to the air/fuel mixture in the cylinders, and thereby causes the relatively heavy air/fuel mixture to remain at or move toward the radial outward portion of the cylinders. The centrifugal forces are also applied to, but have less effect, on the relatively lighter burned exhaust gases. Hence, the exhaust gases will tend to occupy the radial inward portion of the cylinders, and will be continuously forced in the inward direction by the pressurized and expanding relatively heavy air/fuel mixture being directed radially inwardly into the cylinders. This invention therefore maintains the two gases in the cylinders in a generally stratified condition, and causes the incoming air/fuel mixture to scavenge the burned exhaust gases by directing the exhaust gases radially inwardly into a condition for exhausting from the cylinders.

The exhaust porting and manifolding systems of this invention are arranged to direct the exhaust gases in a radial inward direction from the engine cylinders. The exhaust ports are placed in the radially inward portion of the cylinder, and the exhaust manifold is placed radially below the exhaust ports. The opening of the exhaust ports by the operation of the rotary piston valves thus allows the pressure of the supercharged air/fuel mixture to overcome the centrifugal forces on the exhaust gases to discharge the exhaust gases radially inwardly into the exhaust manifold. The exhaust manifold is also designed to promptly reverse the direction of flow of the exhaust gases to discharge the exhaust gases outwardly into an external exhaust manifold. This flow and scavenging of the gases enhances the operational efficiency and output of the engine.

Other objects, features and advantages of the engine of the present invention will become clear from the following detailed description of the engine when read in conjunction with the drawings and appended claims.

BRIEF DESCRIPTION OF THE DRAWINGS

FIG. 1 is a top external plan view of a rotary vee engine constructed in accordance with this invention.

FIG. 2 is an end view of the engine taken along the line 2—2 in FIG. 1 showing the cooling air intake and the cooling air and exhaust portions of the housing.

FIG. 3 is a partial elevational view of the engine as viewed along the line 3—3 showing the cooling air and exhaust manifolds.

FIG. 7 is an elevational view, partly in section, showing the central shaft assembly and stuffer block incorporated into the engine.

FIG. 8 is a cross-sectional view of the stuffer block and shaft assembly taken along the line 8—8 in FIG. 7.

FIG. 20 is a removed partial sectional view taken along the line 20—20 in FIG. 10, showing the conductor contacts included in the engine to fire the spark plugs.

FIG. 21 is a cross-sectional view of the conductor contacts taken along the line 21—21 in FIG. 20.

FIG. 22 is a cross-sectional view, taken along the line 22—22 in FIG. 10, showing the exhaust manifold portion of the engine.

FIG. 23 is a sectional view of the exhaust manifold, taken along the line 23—23 in FIG. 22.

FIG. 29*a* is a cross-sectional view taken along the line 29*a*—29*a* in FIG. 29A.

FIG. 29*b* is a cross-sectional view taken long the line 29*b*—29*b* in FIG. 29A.

FIG. 29*c* is a cross-sectional view taken along the line 29*c*—29*c* in FIG. 29C.

FIG. 29*d* is a cross-sectional view taken along the line 29*d*—29*d* in FIG. 29D.

FIG. 29*e* is a cross-sectional view taken along the line 29*e*—29*e* in FIG. 29E.

FIG. 29*f* is a cross-sectional view taken along the line 29*f*—29*f* in FIG. 29F.

FIG. 29*g* is a cross-sectional view taken along the line 29*g*—29*g* in FIG. 29G.

FIG. 29*h* is a cross-sectional view taken along the line 29*h*—29*h* in FIG. 29H.

FIG. 29*i* is a cross-sectional view taken along the line 29*i*—29*i* in FIG. 29I.

DETAILED DESCRIPTION OF THE DRAWINGS

Figure 4:
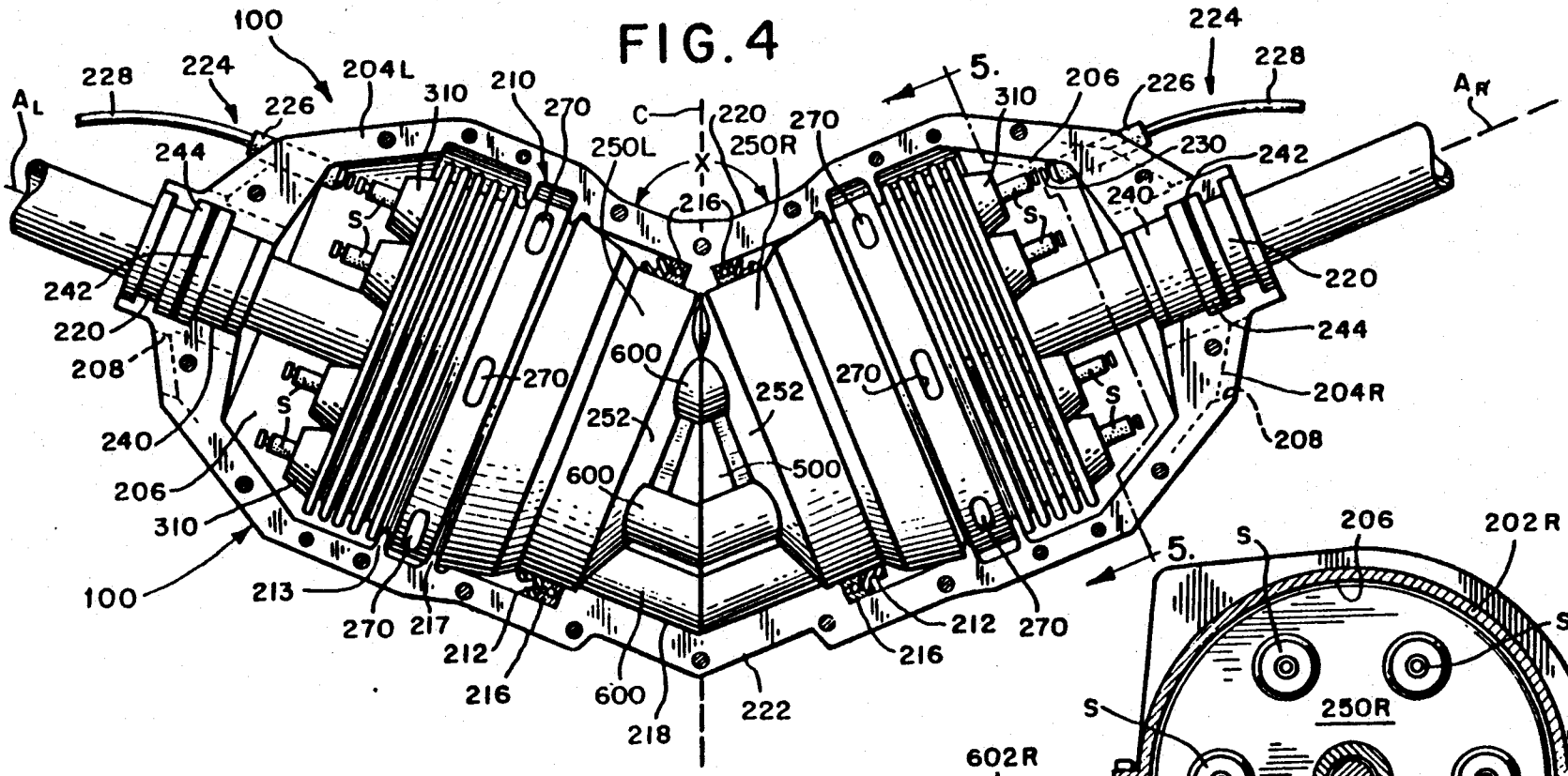
FIG. 4 is a view of the engine along the line 4—4 in FIG. 2, showing the cylinder blocks in place with the top part of the engine housing removed.

The engine 100 illustrated in the drawings is a twelve cylinder engine incorporating several modifications and improvements, in the engine illustrated in Pat. No. 4,648,358, as will be described in detail hereinbelow.

Figure 9:
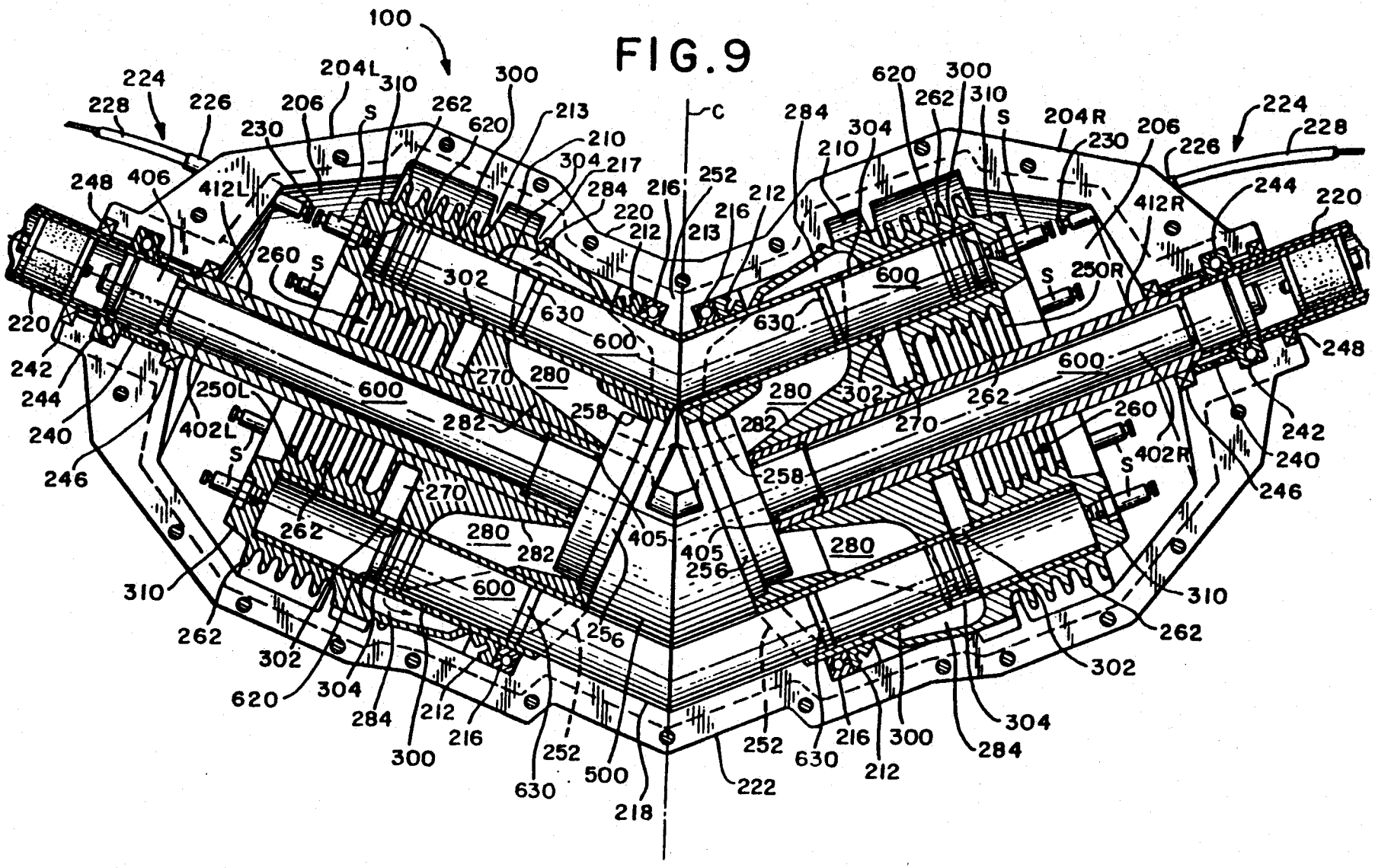
FIG. 9 is an enlarged view of the engine as shown in FIG. 4 with the cylinder blocks and hollow shafts of the shaft assembly shown in cross-section.

The engine 100 includes a split housing 200 which is formed from two cast aluminum sections. As seen in FIG. 2, the upper housing section 202 and the lower housing section 204 are fastened together by means of flanges provided along the mating edges of the housing sections. Only the lower housing section 204 is shown in FIGS. 4 and 9. Each housing section 202 and 204 also defines end sections which are positioned at a selected angle and joined at the center line C of the engine 100. Where appropriate, the left end sections of the housing 202 and 204 are designed 202L and 204L, and the right end sections are designated 202R and 204R, respectively. The left housing section L is essentially a mirror image of the right housing section R of the same housing section 202, 204. The left housings define a central axis of rotation $A_L$, and the right housings likewise define a central axis of rotation $A_R$. The axes of rotation intersect at a selected angle X along the center line C of the engine 100. Angle X is less than 180° and greater than 90°.

As seen in FIGS. 1 and 4, each housing section 202, 204 is formed to define a series of internal cylindrical cavities of differing shapes and diameters when the upper and lower housing sections are joined. Accordingly, the outer end of each housing end section (202L, 202R, 204L and 204R) provides an enlarged semicircular cavity 206 When the upper and lower housing sections are joined, the cavities 206 mate to form a cylindrical air cooling chamber at each end of the engine 100. The air cooling chamber formed by the mating cavities 206 receives a major portion of the cylinder head assembly of the engine 100, as described further below.

As shown in FIG. 2, and as further described in detail in Pat. No. 4,648,358, the outer ends of each housing section 202 and 204 also include a semicircular opening 208 concentric with the respective housing axes $A_L$ and $A_R$. When the housing sections are joined together the openings 208 form an annular air intake port through which cooling air can be drawn axially into each cavity 206 in the ends of the engine by the rotary action of the cylinder assemblies in the housing 200. Adjustable louvers 207, as seen in FIG. 2, are provided in each of the openings 208 to allow the volume of the intake of cooling air to be adjustably controlled. These louvers 207 can be adjusted manually or through some remote or automatic means, not shown.

Figure 10:
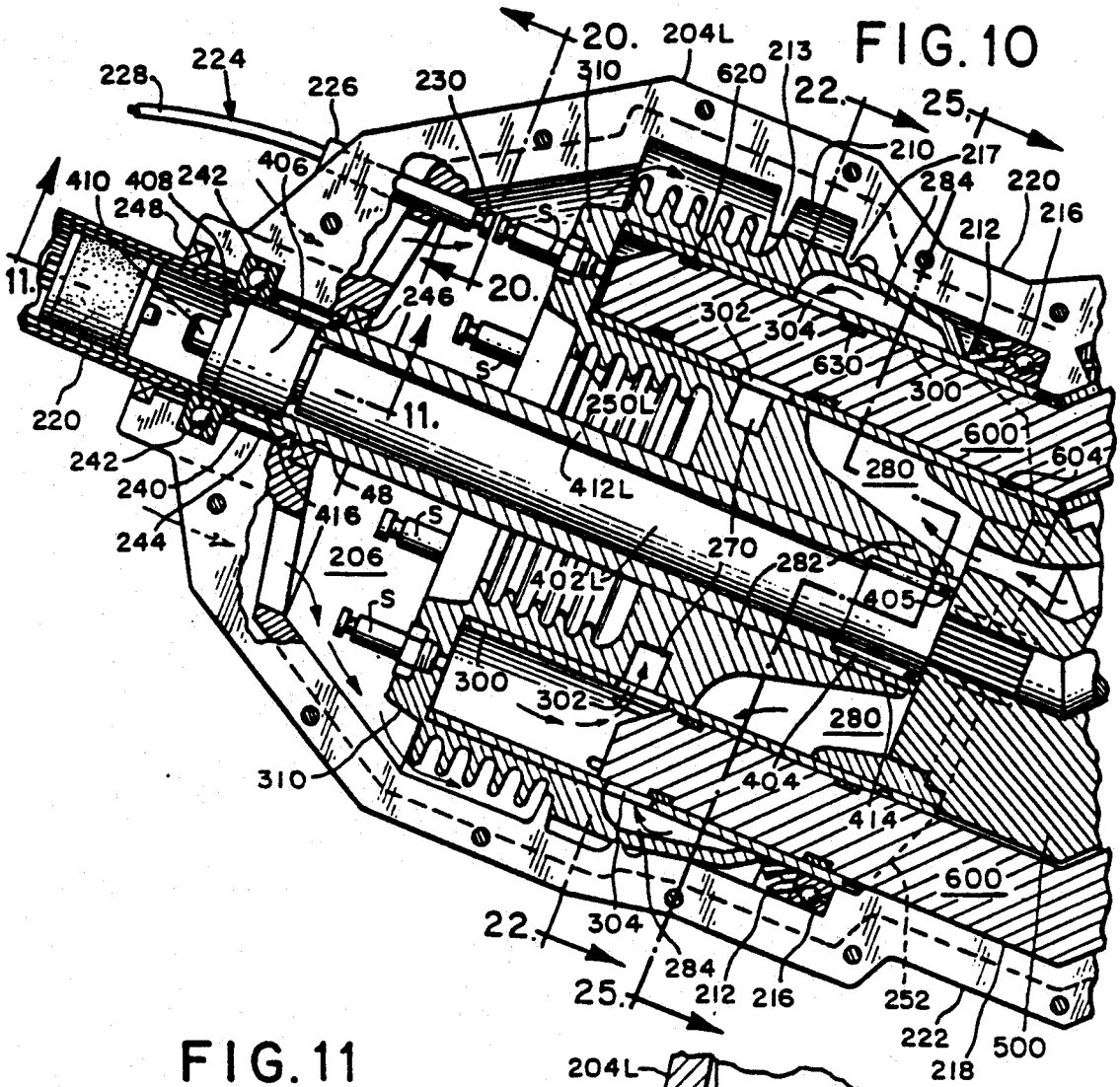
FIG. 10 is an enlarged cross-sectional view of the left-hand cylinder block as shown in FIG. 9, showing the arrangement of the pistons in the cylinder block and the mounting of the cylinder blocks on the support shaft.

The cooling air which is drawn in axially through the openings 208 in the housing 200 is directed radially outward by the rotary motion of the cylinder blocks. A substantial centrifugal force is thereby imparted to the cooling air. As seen in FIGS. 9 and 10, the cylinder blocks are provided with spaced radial fins, openings between the cylinders in the cooling chamber 206, and an annular central chamber. As a result of this construction, the radial air flows by and cools the cylinders provided in the cylinder blocks by moving outwardly between the cooling fins, and thereby dissipates the heat created by the operation of the engine 100. As seen in FIGS. 2 and 3, the housing sections 202, 204 in this cooling section of the engine are cast to define an expanding torus-shaped air chamber 205 to direct the cooling air in an expanding volume to a cooling air discharge port 209. The air outlet port 209 allows the cooling air to be discharged from the air cooling cavity 206 into the surrounding atmosphere. Adjustable louvers 209L, as shown in FIG. 3, can be provided in the air outlet port 209 to allow further control over the flow of the cooling air through the engine 100.

The intermediate portion of each housing section 202, 204 also defines an exhaust ring 210 in the housing 200. The exhaust ring made up of the mating cavities 210 is in fluid communication with the exhaust ports in each cylinder of the engine 100. As shown in FIGS. 2, 3 and and 23, the exhaust ring 210 is adjacent the cooling air chamber 206 and has a similar expanding torus shape to facilitate the removal of the exhaust gases from the engine. The exhaust ring 210 also includes an outlet opening 211 in the wall of the housing which leads to a suitable exhaust manifold. The exhaust ring in each engine section 202, 204 thus functions to collect the exhaust gases from each adjacent cylinder during the operation of the engine.

A divider wall 213 can be provided in the housing 202L to separate the discharging cooling air from the exhaust gases. This arrangement is particularly appropriate when the cooling air chamber 210 is provided with the adjustable louvers 209L. If desired for particular engine applications, the divider wall 213 can be eliminated so the exhaust gases are mixed with and are cooled substantially by the exiting cooling air. A second smaller divider wall 217 is also formed in the exhaust chamber 210 to block the exhaust gases from the inner portions of the engine containing the air/fuel mixture. (See FIG. 23).

The exhaust cavity 210 in each engine section 202, 204 is sealed from the inner ends of each engine section by a sealing ring 212. Each ring 212 is positioned within the respective housing section 202, 204 on the outside of a roller bearing 216. The bearings 216 function to stabilize the rotation of inner end of the adjacent cylinder block within the housing 200, as described further below. The seals 212 function to create a seal between the adjacent rotating cylinder block and the housing 200, to prevent the exhaust gases from moving further inwardly between the cylinder block and the housing toward the center line C of the engine 100.

The central portion of the housing sections 202, 204 between the bearings 216, and centered on the center line C, defines a bent axis cylindrical wedge-shaped chamber 218 into which air fuel mixture is supplied to the engine 100. The seals 212 and the divider wall 217 operate to seal the exhaust ring portion 210 of the engine from this air-fuel chamber 218.

The side 220 of the housing 200 toward which the axes $A_L$ and $A_R$ are angled (the top side in FIG. 1) comprises the top-dead-center side for the engine 100. The opposite side 222 (the lower side in FIG. 1) comprises the bottom-dead-center side. Each piston 600 in the engine 100 is fired a few degrees of rotation in advance of reaching the top-dead center side 220 during the operation of the engine. Accordingly, the outer end of each housing section 202 and 204 include a spark plug contactor assembly 224 positioned closely adjacent the top-dead center side 220. As shown in FIGS. 20 and 21, the contactor assembly 224 comprises an insulator sleeve 226 extending through the outer end of each housing section 202, 204 slightly below the flanges provided to join the two housing sections together. An electrical conductor 228 extends through the insulator sleeve 226 and terminates in an arcuate electrical contact 230. The conductors 228 and contacts 230 are connected to an ignition system, such as magneto system (See FIGS. 14 and 15) which produces a timed high-voltage spark to fire the spark plugs on the associated cylinder block assembly as the plugs are sequentially rotated into close proximity to the contacts 230. The spark plug contactor assemblies 224 and the ignition system are arranged so that the spark plugs slightly in advance of the top-dead center position for both cylinder block assemblies are fired simultaneously. As seen in FIGS. 20 and 21, this advanced spark arrangement is caused by providing each electrical contact 230 with a selected arcuate length, so that each rotating spark plug S is in a position to be energized by the contact 230 a selected degree 'Y' in advance of reaching the top dead center position.

Figure 11:
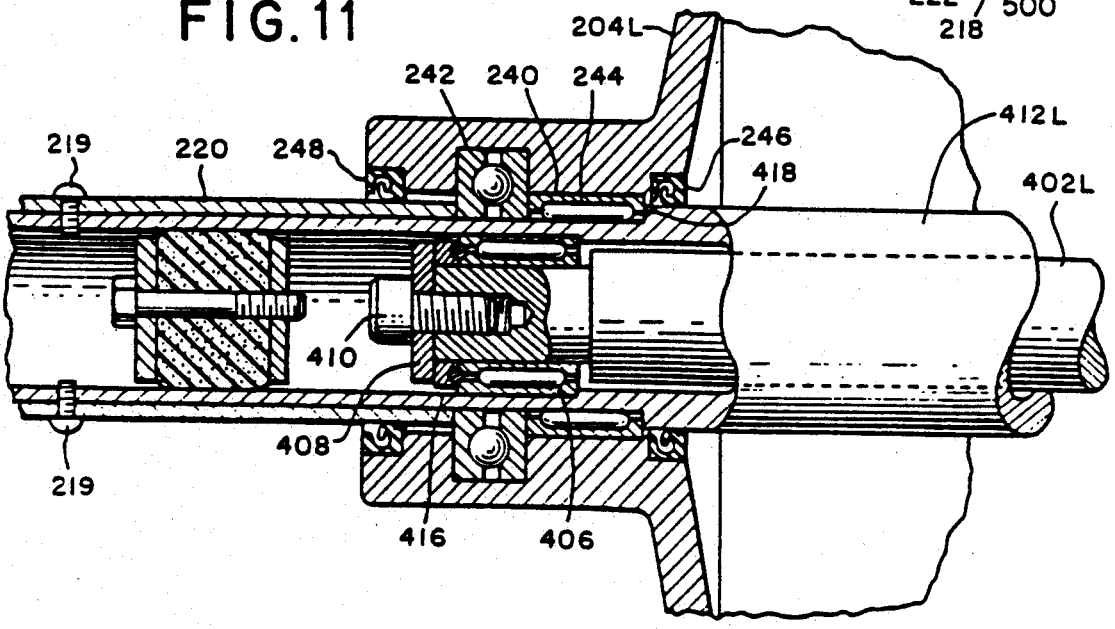
FIG. 11 is an enlarged cross-sectional view taken along the line 11—11 in FIG. 10 showing the arrangement of the bearings for mounting the support shaft in the housing and for mounting the hollow shafts on the central solid shafts.

Each of the housing sections 202 and 204 also includes bearing supports for receiving and supporting the shaft assembly of the engine 100. As shown in FIGS. 9, 10 and 11, the outer end of each housing section 202L, 202R and 204L, 204R is provided with a semicircular inner bore 240 and an enlarged semicircular outer bore 242. Each bore 240, 242 is in axial alignment with the respective axes $A_L$ or $A_R$ of the related housing section 202, 204. When the mating housing sections 202 and 204 are joined the bores 240, 242 form circular apertures which are adapted to receive a combined roller and thrust bearing 244. Additional recesses formed in the housing adjacent the bores 240, 242 are adapted to contain an inner O-ring type seal 246 and an outer O-ring type seal 248. The bearings 244 receive and support a hollow shaft portion 412 of the engine shaft assembly 400 on the ends of the housing sections 202 and 204 while the seals 246 and 248 seal the shaft assembly and the housing 100 from the exterior surroundings.

The bearings 244 also will absorb thrust loads transmitted to the bearings from either direction by the external loads on the engine. As seen in FIGS. 9, 10 and 11, the thrust loads are transferred to the thrust bearing 244 in the outer direction by means of a shoulder 418 provided on the hollow shaft 412 to abut against the bearing 244. Inward thrust loads are transferred to the bearing 244 by a thrust sleeve 220 that is pinned, such as by a rivet 219, to the outside of the hollow shaft 412 in abutment with the outside of the bearing 244.

As seen in FIGS. 4 and 9, the left housing portions 202L, 204L house a cylinder block 250L, and the right housing portions 202R, 204R likewise houses a cylinder block 250R. The cylinder blocks 250L, 250R are mirror images of each other. Hence, identical features and components have been designated by the same reference numerals. Each cylinder block 250L, 250R is generally cylindrical in shape, and includes an interior end positioned adjacent the center line C of the engine 100 when the engine is assembled in the housing 200. The exterior end of each of the cylinder blocks 250L, 250R is positioned adjacent the outer ends of the housing 200, as shown in FIG. 4. The left cylinder block 250L is centered about the rotational axis $A_L$ and the right cylinder block 250R is centered about the rotational axis $A_R$.

As further seen in FIGS. 4 and 9, the interior end of each of the cylinder blocks 250L and 250R includes an annular beveled surface 252 defined in the outer radial portion of the cylinder blocks. The beveled surfaces 252 on the cylinder blocks 250L, 250R are axially spaced by a substantial distance at the bottom-dead-center side 222 of the engine. In contrast, the two beveled surfaces 252 are in a close sealing relationship at the top-dead-center side 220 of the engine. The parts are machined to allow for heat expansion so that the beveled surfaces 252 do not bind at this top-dead-center side 220. In operation the surfaces 252 rotate approximately a few thousandths of an inch apart at the top-dead-center side 220. The surfaces 252 will thereby form an effective seal which will assist in containing the air/fuel mixture in the central chamber 218 of the engine housing 200. A second annular surface extends radially inwardly from the beveled surface 252 toward the center of rotation of each cylinder block 250L, 250R.

As shown in FIG. 9, the second annular surface is a multiple-stepped surface, including the steps 256 and 258. The stepped surfaces 256,258 are designed to receive complimentary stepped surfaces 502 and 504, respectively, on the end of a stuffer block 500 positioned in the center of the engine 100, as shown in FIGS. 7 and 8. The mating stepped surfaces on the cylinder blocks 250L, 250R and stuffer block 500 will operate to impede the escape of air/fuel mixture from the central portion of the engine 100. The complementary stepped surfaces are spaced sufficiently close to prevent any substantial gas flow, but are spaced apart sufficiently so that heat expansion will not cause binding of the cylinder blocks and stuffer block 500 during the operation of the engine 100.

The exterior end of each cylinder block 250L and 250R includes a central opening 260 which provides the exterior end of each block with an annular opening. A plurality of coaxial rings 262 on the annular exterior end of the cylinder blocks and the annular interior of the opening 260 provide air cooling surfaces and pathways for the cylinder blocks during the operation of the engine. To accomplish this arrangement, the cylinder block 250L and 250R are cast to provide radial openings between the rings 262 in the portions of the blocks between the cylinder and piston assemblies.

As seen in FIGS. 4 and 23, a portion of each cylinder block 250L, 250R is formed to define an exhaust chamber 270 for each engine cylinder 300. Each chamber 270 is axially aligned with radially inward exhaust ports 302 in each cylinder 300, so that the spent combustion gases are directed from each cylinder in a radially inward direction into the associated chamber 270. As seen in FIG. 22, the exhaust chambers 270 are then curved to extend in an arcuate and expanding fashion to the periphery of the cylinder block 250L, 250R between the cylinders 300. The chambers 270 are thereby placed into fluid communication with an adjacent exhaust cavity 210 of the housing 200, which in turn is in communication with an exhaust manifold, not shown. The operation of the engine maintains the exhaust gases under pressure so that the gases, which were initially directed radially inward, are rapidly redirected in a radially outward direction from the exhaust chambers 270 into the exhaust cavities 210 in the housing 200, and then out through the exhaust manifold.

Figure 25:
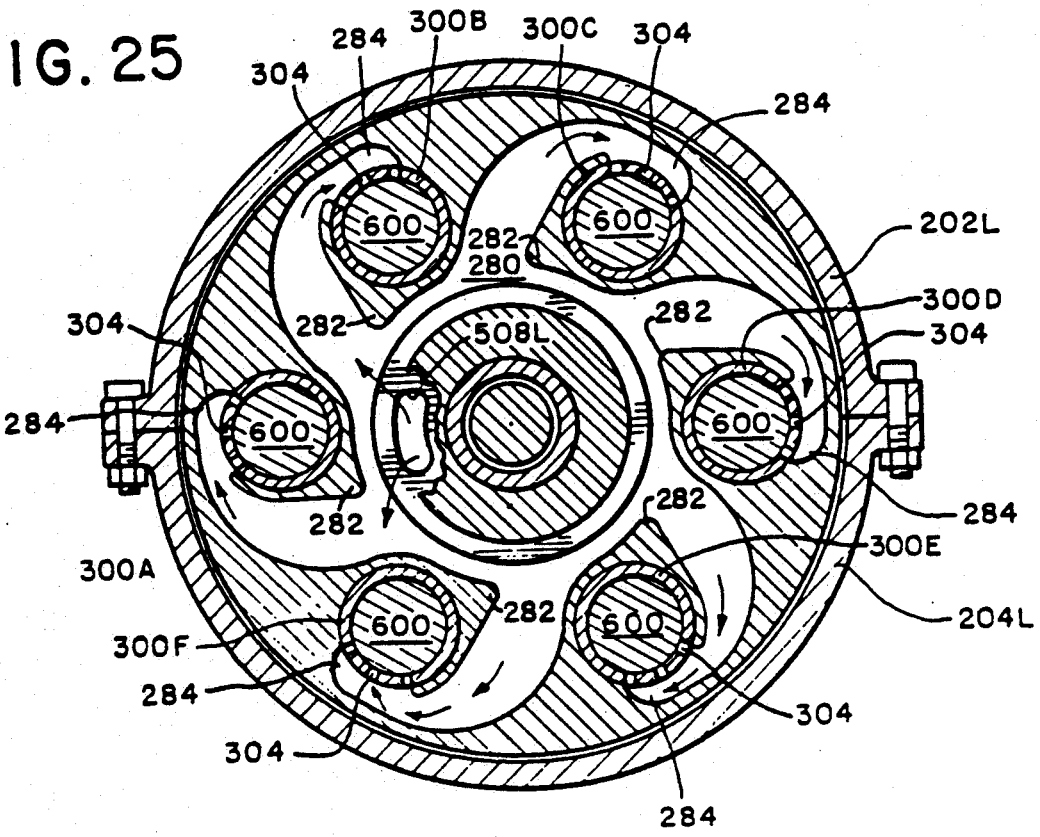
FIG. 25 is a cross-sectional view of the air/fuel intake manifold portion of the engine, taken along the line 25—25 in FIG. 10.

The interior ends of each cylinder block 250L, 250R are cast to provide the cylinder block with an axially and radially extending cavity that defines an air/fuel intake manifold 280 for each cylinder 300A–F. As shown in FIGS. 9, 10 and 25, each manifold 280 is provided with evenly spaced axial fins 282 which assist in imparting a substantial rotational and centrifugal force to the air/fuel mixture passing through each manifold 280.

The interior ends of each manifold 280 are positioned toward the centerline C of the engine. The interior ends of each manifold 280 are open so that each manifold is in fluid communication with the air/fuel chamber 218 defined in the central portion of the housing 200. Each manifold 280 continues radially outwardly past the adjacent cylinder, and then extends axially outwardly along the cylinder. The manifold 280 thereby defines an outer air/fuel inlet chamber portion 284 that is positioned radially outwardly of each cylinder 300. Each inlet chamber 284 is in direct fluid communication in a radially inward direction with an air/fuel inlet port 304 provided in each cylinder 300. The air/fuel mixture is directed, by pressure forces created by the rotation of the cylinder blocks, from the central air/fuel chamber 218 into the manifolds 280. The fins 282 in the manifolds 280 impart additional velocity to the air/fuel mixture so that the mixture is forced radially outward under high pressure into the inlet chambers 284. The air/fuel mixture is thereby positioned radially outwardly of the engine cylinders 300. This air/fuel charge is subjected to a supercharged pressure which is sufficient to overcome the centrifugal forces working on the charge in order to force the charge into the engine cylinders 300 through the associated intake ports 304.

As seen in FIGS. 7 and 9, the stuffer block 500 is a cast member, made from lightweight aluminum or other suitable material, such as a light-weight plastic. In the preferred arrangement, the stuffer block 500 is formed or cast in place on the solid shafts 402L and 402R, at the vee-shaped junction of the shafts, as shown in FIG. 7. The left and right faces of the stuffer block 500 are formed to have a cylindrical configuration which includes the above-described steps 502 and 504. The central body of the stuffer block is formed in the shape of two intersecting truncated cylinders 506L and 506R, which provide the central portion of the stuffer block 500 with a generally wedged shape.

As shown in FIG. 9, the stuffer block 500 is designed to be positioned within the central space 218 of the engine 100 between the rotating cylinder blocks 250L and 250R and inside of the rotating pistons 600. The portions 506L and 506R of the stuffer block are dimensioned so that they extend between the cylinder blocks 250L and 250R. The periphery of the stuffer block 500, on the side adjacent the top dead center side 220 of the engine, is provided with a bent-axis cylindrical and wedge-shaped cavity 510. This cavity is in fluid communication with the central opening 218 defined in the housing and is adapted to receive the air/fuel mixture being fed into the engine 100 through a suitable carburetor inlet 210 (see FIG. 1). As shown in FIG. 8, this cavity 510 extends transversely from the periphery of the stuffer block 500 past the central portion of the stuffer block. A pair of axial and arcuately shaped passageways 508L and 508R are provided in the stuffer block to bring the cavity 510 into fluid communication, in an axial direction along the length of the shafts 402L and 402R, with the air/fuel manifolds 280 defined in each of the rotating cylinder blocks 250L, 250R.

The stuffer block 500 and the solid shafts 402L and 402R are stationary during the operation of the engine. As seen in FIG. 9, the dimensions of the stuffer block place the block centrally in the engine 100 so that the pistons 600 orbit around the stuffer block within the central engine cavity 218. Because of this arrangement, air/fuel mixture directed into the stuffer block cavity 510 from a carburetor system will be compressed and supercharged in the cavity 510 by the rotary action of the cylinder blocks 250L, 250R and the orbiting action of the pistons 600 within the central chamber 218. This supercharged air/fuel mixture will then be directed axially out of the chamber 510 into the air/fuel manifolds 280 in each cylinder block 250L, 250R through the passageways 508L, 508R. The manifolds 280 then conduct the supercharged air/fuel mixture into the engine cylinders, as described further below.

Figure 5:
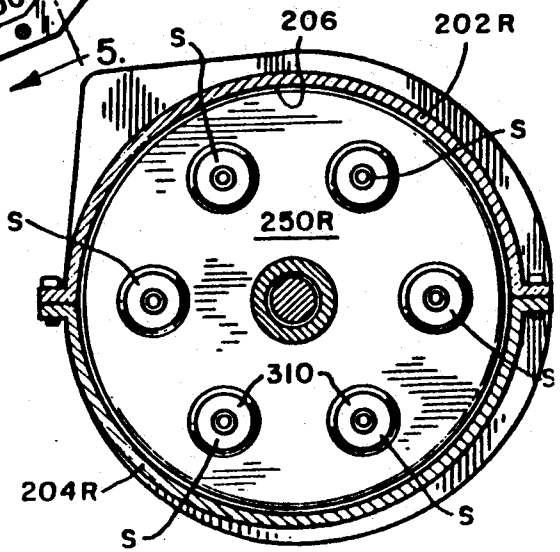
FIG. 5 is a sectional view of the end of the cylinder housing and cylinder block, as seen along the line 5—5 in FIG. 4, shown with the top housing portion in place.

Each cylinder block 250L and 250R includes six cast-in-place cylinder sleeves 300A through 300F. As shown in FIG. 5, these sleeves 300A–F are uniformly spaced in an annular arrangement around the axis of rotation $A_L$ and $A_R$ of the cylinder blocks. Each cylinder sleeve 300 is preferably integrally cast within the cylinder block during the aluminum casting operation. The interior end of each cylinder sleeve 300 is beveled, so that the interior end of each sleeve will be in alignment with the beveled surface 252 on the respective cylinder block 250L, 250R, as shown in FIG. 9. Each sleeve 300 is axially aligned to be parallel to the respective axis of rotation $A_L$ or $A_R$ of the cylinder block 250L or 250R The sleeves 300A–F are further positioned so that the sleeve 300A in cylinder block 250L intersects with sleeve 300A in block 250R along the centerline C when the sleeves are positioned at the top-dead center side 220 of the engine. Moreover, each sleeve 300A–F in cylinder block 250L is axially aligned with the corresponding sleeve 300A–F in the other cylinder block 250R along centerlines which are parallel to the angled axes of rotation $A_L$ and $A_R$. Due to this alignment, the centerlines of the aligned sleeves 300A–F in cylinder 250L would intersect with the centerlines of the sleeves 300A–F in cylinder 250R at the engine centerline C. This alignment is maintained through the rotation of the cylinder blocks 250L, 250R during the operation of the engine.

Figure 6:
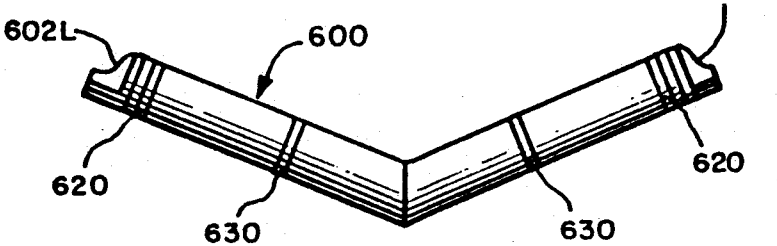
FIG. 6 is a removed plan view of one embodiment of a piston incorporated into the engine.

Each of the aligned cylinder sleeves 300A–F is provided with a piston member 600 (see FIGS. 6 and 9). A solid embodiment for the piston 600 is shown in FIG. 6. The head or outer ends 602L and 602R have a specifically programmed shape, as explained in more detail below, so that the heads 602L, 602R function as rotary valves during the operation of the engine. One or more piston rings 620 are provided in the piston adjacent each head 602 to seal the compression/ignition chamber defined at the ends of the piston in the conventional manner. In accordance with this invention, the intermediate portion of each piston 600 is also provided with a pair of spaced sealing rings 630. These rings 630 function to seal each end of each piston and cylinder sleeve combination from the central air/fuel chamber 218 of the engine 100. The rings 630 also act as oil wiper and sealing rings to prevent the leakage of lubricating oil into the air/fuel chamber 218.

Alternatively, the functions of the piston rings 630 can be performed by a seal 640. As seen in FIGS. 9 and 10, the seal 640 is an O-ring type seal mounted in the interior wall of each cylinder 300 adjacent the inner end of the cylinder.

As discussed above, a disadvantage of rotary vee engines of prior designs was the tendency of the two angled sections of the engine comprising the cylinder blocks 250L, 250 to move toward a straightened condition in response to the forces created by the operation of the engine. The design and operation of the support shaft assembly 400 in accordance with this invention provides the engine with a solid central member which resists and overcomes this straightening force inherent in rotary vee engines. The operation of this support shaft assembly 400 allows the use of the solid pistons 600, as described above, in many engine applications with normal machine tolerances between the pistons 600 and the associated cylinder sleeves 300.

It has been found that the orbiting pistons in a rotary vee engine experience intertial loads in the range of 2500g at about 5000 rpm in some engine configurations. This substantial loading tends to break down the lubricating film barrier between the pistons and the cylinders and cause an increase in friction in the engine. Therefore, in another aspect of this invention the rotary vee engine can be provided with a piston which substantially reduces the effect of the centrifugal forces and inertial loads applied to the pistons as the pistons orbit in the cylinders during the operation of the engine. This reduction in forces substantially reduces the bearing loads between the pistons and the cylinder sleeves, so that friction and wear between the piston and the cylinders are minimized.

Figure 13:
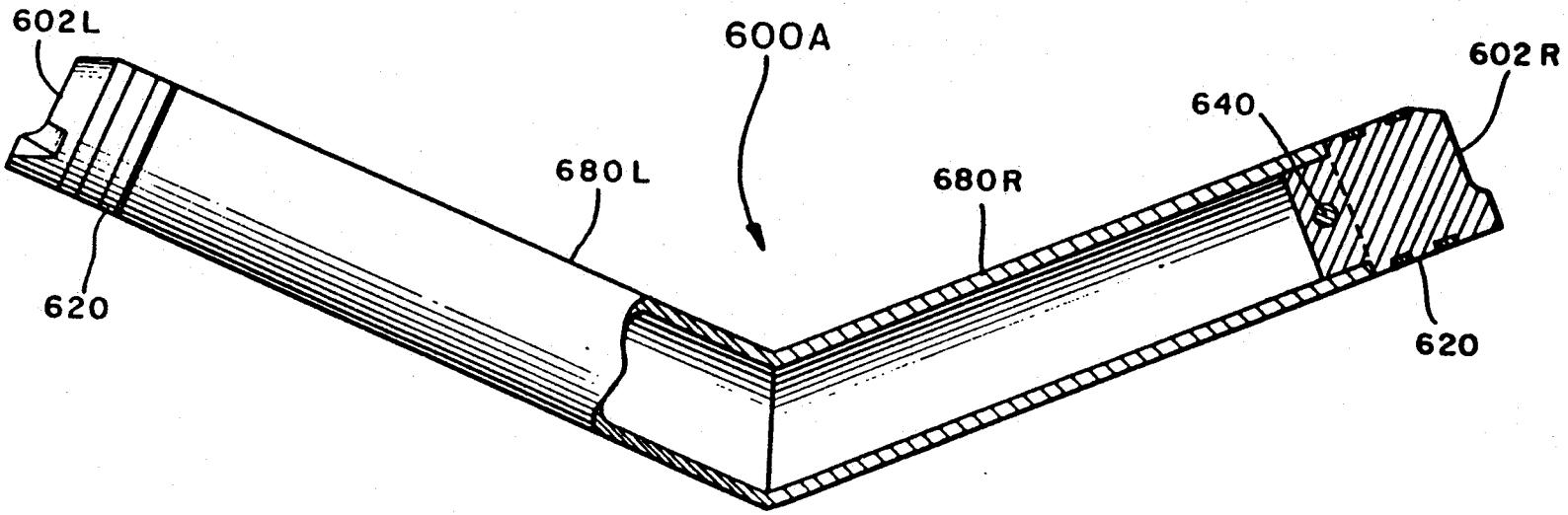
FIG. 13 is an elevational view, in partial section, of a light-weight and low inertial load piston which can be incorporated into the engine.

FIG. 13 illustrates an embodiment of an improved piston 600A which incorporates these features and advantages. The angled piston 600A comprises a hollow tubular piston body 680L connected at a selected angle to a second hollow piston body 680R. The bodies 680L,R can be formed by boring out a solid piston rod to have a selected wall thickness which is uniform throughout the axial length of the piston. A wall thickness in the range of one-eighth to three-sixteenths of an inch has been found sufficient to withstand the forces applied to the piston in the engine. As seen in FIG. 13, the outer end of each piston body is open. The resulting hollow piston 600A has low weight and mass.

The piston 600A further includes a piston head 602L fixed in the open outer end of the body 680L and a similar piston head 602R fixed in the open end of the body 680R. Each head includes piston rings 620, as described above. As further described above, each piston can also be provided with the second set of piston rings 630 as shown in FIG. 6. A wrist pin 640, or other suitable means such as threads, can be used to secure the piston heads to the adjacent piston body.

Since the piston bodies 680L,R are hollow, the weight and mass of the piston 600A is substantially reduced. The centrifugal force and inertial loads on the piston are accordingly reduced so that the bearing loads between the piston and the cylinder sleeve are minimized. The resultant wear between the piston and the associated cylinder sleeve is thereby likewise minimized.

The cylinder sleeves 300A–F terminate near the exterior end of the cylinder blocks 250L, 250R. As seen in FIG. 9, cylinder heads 310 are formed in the ends of the cylinder blocks 250L, 250R in axial alignment at the outer end of each sleeve 300A–F. A spark plug S is provided in each cylinder head 310 and arranged in the conventional manner so that the spark-gap end of the plug extends into the interior of the associated cylinder sleeve 300A–F. The external end of each spark plug S is positioned to rotate into close conductive relationship to the fixed electrical contact 230. As shown in FIGS. 20 and 21, each contact 230 has an arcuate shape that is positioned to be in close relationship (i.e., by a gap of 0.030 inches) to the rotating spark plugs S. The arc of the contact 230 extends from an advanced point, e.g., twenty-five degrees before the top dead center 220 of the engine. The plugs S therefore rotate with the cylinder blocks 250L, 250R, and are fired a few degrees of rotation before the top-dead-center side 220 of the engine by electrical conduction from the contacts 230.

The engine 100 also includes an angled support shaft assembly 400. The assembly 400 supports the cylinder blocks 250L, 250R for rotation within the housing 200 and provides the engine 100 with dual power output shafts. The left-hand end of the shaft assembly 400 includes a solid support shaft portion 402L, and the right hand end likewise includes a solid support shaft portion 402R. Each shaft portion 402L, 402R is concentric with the respective axis of rotation $A_L$, $A_R$ of the related cylinder block 250L, 250R.

In the preferred embodiment, the shaft portions 402L, 402R comprise a solid shaft that is pre-bent to the desired angle. As shown in FIG. 7, stuffer block 500 is cast or otherside formed onto the central portion of the bent shaft portions 402L, 402R and machined to the proper angle and configuration. The shaft portions 402L, 402R and the stuffer block 500 thereby form a solid one-piece support shaft structure which will resist the thrust and bending forces created by the operation of the engine 100. The interior end of each shaft 402L, 402R includes a slightly enlarged portion that receives a roller bearing 404.

As seen in FIGS. 4 and 9, the solid shafts 402L, 402R extend outwardly to the ends of the respective housing 202L or 202R, so that the ends of the shafts 402L, 402R will be supported by the housings 200. The outer end of each support shaft 402L, 402R also includes a reduced-diameter portion which will receive a combined roller and thrust bearing 406.

The shaft assembly 400 also comprises a pair of hollow output shafts 412L and 412R. As shown in FIGS. 4, 9 and 11, the hollow shaft 412L is positioned over and concentric with the solid shaft 402L, and the hollow shaft 402R is positioned over and concentric with the solid shaft 402R. In the preferred arrangement the hollow shafts 412L, 412R are fixed to the associated cylinder blocks 250L, 250R by being cast or formed in place when the aluminum cylinder block is cast. The hollow shafts 412L, 412R are positioned in the blocks 250L, 250R to be parallel to the cylinder sleeves 300A–F and concentric with the respective rotational axis $A_L$ or $A_R$.

The inner end of the hollow shafts 412L, 412R are closely adjacent the stuffer block 500, and include bearing recesses 414. As shown in FIG. 9, the bearings 404 are press-fit into the recesses 414 so that the bearings 404 are carried by the hollow shafts 412L, 412R. A ring seal 405 is also carried by the shafts on the inside of the bearings 404 to seal against the stuffer block 500. The interior ends of the cylinder blocks 250L, 250R and the hollow shafts 412L, 412R can thereby rotate around the solid shafts 402L, 402R on the bearings 404. Since bearings 404 are press-fit into the recesses 414 they are restrained from axial movement by friction and by a shoulder defined on the shafts 412L, 412R by the recesses 414. The bearings 404 are also restrained from inward movement by the stuffer block 500.

The exterior ends of the hollow shafts 412L, 412R extend outwardly beyond the ends of the solid shafts 402L, 402R and beyond the ends of the housing 200. The combined roller and thrust bearing 406 is press-fit into an internal bearing recess 416 on the exterior end of each of the hollow shafts 412L, 412R, as clearly shown in FIG. 11. A shoulder formed by the recess 416 prevents inward movement of the bearing 406 and transfers thrust loads to the bearing Outward movement of the bearings is precluded by retaining plate 408 bolted to the shafts 402L, 402R by a bolt 410. The bearings 406 thus support the exterior end of the hollow shafts 412L,

412R and the associated cylinder blocks 250L, 250R for rotation about the solid shafts 402L, 402R. The bearings 406 transfer and absorb the axial thrust loads applied to the cylinders 250L, 250R and the hollow shafts 412L, 412R during the operation of the engine 100.

As seen in FIGS. 9-11, the bearings 244 in each end of the housing 200 rotatably support the hollow drive shafts 412L, 412R, and the drive shaft assembly 400 on the housing 200. As described above, a shoulder 418 on the hollow shafts 412L, 412R will transmit any outward thrust load to the bearings 240, 244. Similarly, a sleeve 420 pinned to the outer portions of the hollow shafts 412L, 412R will transmit any inward thrust loads to the bearings 244. The bearings 244 are thereby arranged to absorb any thrust loads transmitted to the housing in either direction by external loads created by the operation of the engine.

The operation of the engine 100, and the resulting rotation of the cylinder blocks 250L, 250R creates a rotary output driving force through the connected hollow shafts 412L, 412R. Since both shafts 412L and 412R extend beyond the housing 200, the engine 100 is thereby provided with dual output drive shafts, with one drive shaft at each end of the housing.

The dual output shafts 412L and 412R provide the engine 100 with substantial versatility. One output shaft can be employed as the main output, to drive a transmission or the like. The other output shaft can be used simultaneously to power auxiliary equipment, such as a generator or the like. Alternatively, the two shafts 412L and 412R can be coupled to similar transmissions, to drive similar components, such as two separate drive wheels.

Figure 12:
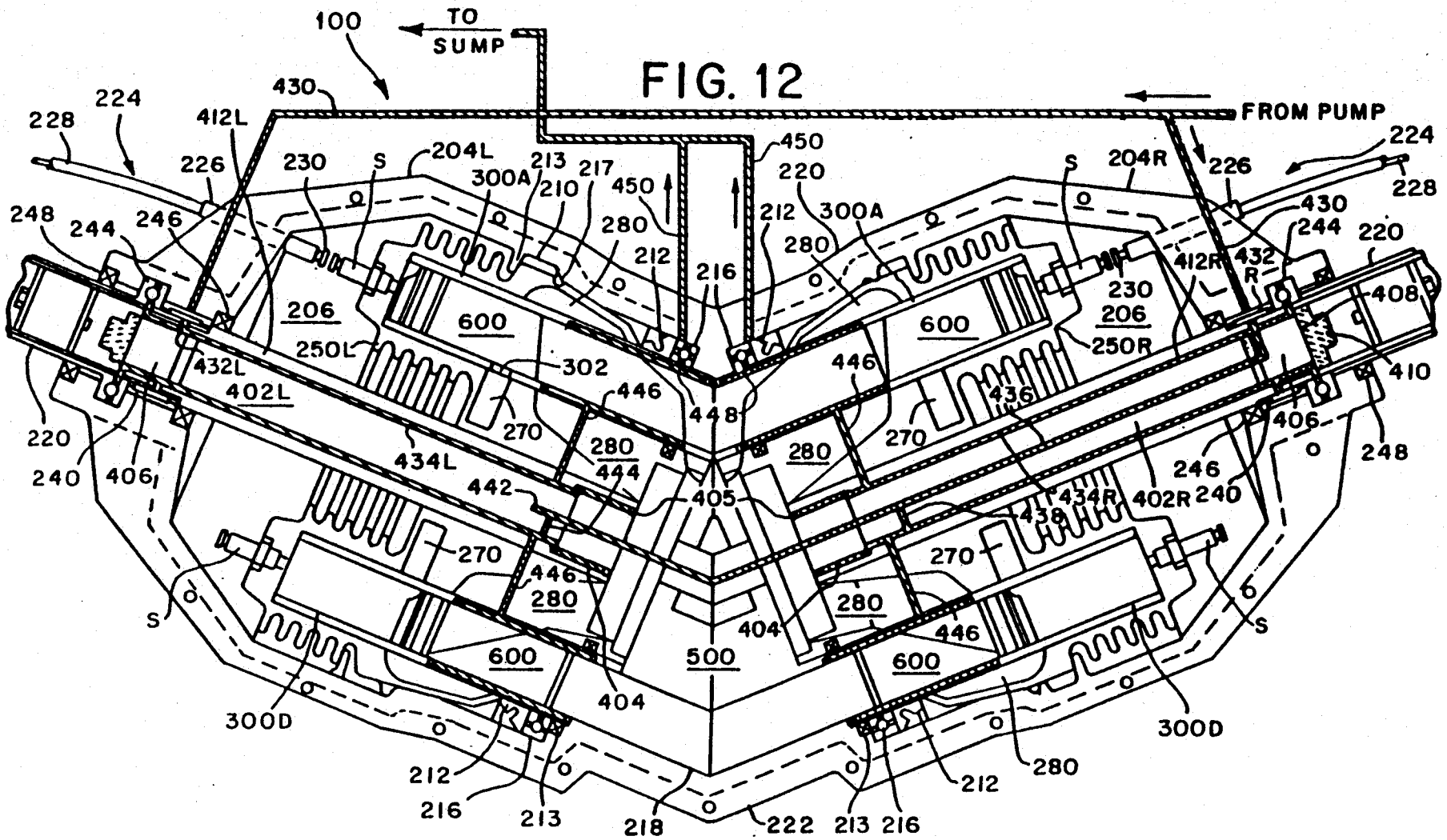
FIG. 12 is a cross-sectional view of the engine similar to FIG. 9 illustrating the oiling system incorporated in the engine in accordance with this invention.

FIG. 12 illustrates a dry sump oiling system that can be incorporated into the engine 100 when the engine is not lubricated with an oil/gas mixture. This oiling system is designed to use the centrifugal forces created by the operation of the engine to distribute oil to all necessary locations. The oiling system preferably employs an oil injection pump P, shown schematically in FIG. 12, to pump a selected quantity of oil per revolution through the engine 100 from the oil sump S.

The components of the engine 100 which are lubricated by the oiling system shown in FIG. 12 are the roller and thrust bearings 406, the outer bearings 240, 244, the roller bearings 404, the inner bearings 216 and the surfaces between the cylinder sleeves 300A-F and the pistons 600. The inlet port 430 for the oiling system is provided at one end or both ends of the engine 100 in fluid communication with the adjacent bearing 240. The bearing 240 is of the type that allows oil to flow radially through the bearing races. The ports 430 are connected to an external low pressure oil supply pump (not shown).

The oil system further includes a radial bore 432 in the hollow shaft 412R and in the adjacent portion of the solid shaft 402R. The bore 432R is radially aligned with the port 430, and introduces oil from the port 430 into the annular space 434R between the solid shaft 402R and the hollow shaft 412R. The bore 432L likewise is aligned with the adjacent port 420, and directs oil into the annular space or chamber 434R. The bore 432R also connects the port 430 to a central oil bore 436 which is drilled along the axis of the solid shaft portion 412R. Another radial bore 438, positioned near the center of the engine 100, is provided in the solid shaft 412R to insure the fluid communication between the central bore 436 and the annular space 434.

As seen in FIG. 12, the left solid shaft portion 402L is also provided with a central bore 442 which extends into fluid communication with the bore 436. A radial bore 444 extends from the bore 442 into the annular space 434L between the hollow shaft 412L and the solid shaft 402L. The oil can thereby flow through the central bores 436, 442 into the annular spaces 434L and 434R to lubricate the bearings 404 and 406. Also, the radial bore 432 in the hollow shafts 412L, 412R allow the oil to flow from the bearings 406 into the outer bearings 240, 244. The plate 408 at the outer end of each solid shaft 402L, 402R (See FIG. 11) maintains the bearings 406 and the other components in the proper position As also seen in FIG. 11, the outer ends of the hollow shafts 412L, 412R also include an expandable oil plug 411 that seals the ends of the hollow shafts to prevent oil leakage.

The oiling system further includes passageways to direct oil to each of the cylinder sleeves 300A-F, to lubricate the pistons 600 reciprocating within the sleeves. Accordingly, each cylinder block 250L and 250R is provided with six radial oil channels 446. Each channel 446 extends radially from the associated annular space 434L or 434R to one of the cylinder sleeves 300A-F. The channels 446 extend through the sleeves 300A-F so that oil will be introduced onto the inside surfaces of each cylinder sleeve As shown in FIG. 12, the channels 446 are located at an intermediate point along the length of the sleeves 300A-F. The lubricating oil thereby remains below the combustion chamber defined at the outer end of each sleeve.

Each sleeve 300A-F also includes an oil passageway 448 radially positioned between the seal 212 and the roller bearing 216 on the same side of the engine as the ports 430, to direct oil to the bearings 216. The bearing 216 is also of the type that allows oil to flow radially through the bearing races. O-ring seals 212 on the side of the bearing 216 prevent the oil from leaking laterally from the bearing 216. The oil is thus blocked from leaking outwardly into the exhaust cavity 210 by the seals 212, and inwardly into the air/fuel chamber 218 by the seals 640 in the cylinder sleeves.

An oil outlet port 450 is provided in the housing section 202 or 204 in alignment with each passageway 448. As shown in FIG. 12, the ports 450 can be positioned at the same side of the engine 100 as the ports 430, or at other locations that constitute the lowest point of the engine. Location of the ports 450 at the lowest point, which depends on engine orientation, will assist in the draining of the oil from the engine into the external oil sump (not shown).

The distribution of the oil throughout the above-described system is assisted by the centrifugal forces created by the operation of the engine 100. As the engine operates and the cylinder blocks 250L and 250R rotate, oil is directed under low pressure into the inlet port 430. The oil flows through the bore 432 into the central bores 436, 440 and 442, and through the radial bores 438, 444 into the annular spaces 434L and 434R. The oil is thereby directed to and lubricates the bearings 404 and 406.

The oil continues to flow radially from the spaces 434L, 434R through the channels 446 and into each cylinder 300A-F. The radial channels 446 to the cylinders 300A-F can be small in diameter, due to the effect of the centrifugal forces in the engine. The friction surfaces between the pistons 600 and the cylinder sleeves 300A-F will thereby be lubricated by the oil.

The centrifugal forces in the engine continues the flow of oil through the radial outlet ports 450 in each sleeve 300A-F. The oil thereby returns to the external oil storage sump, from which it will be recirculated through the engine 100.

The sleeves 300A-F and the associated pistons 600 also include sealing rings to contain the oil in the proper locations. As seen in FIGS. 6, 9 and 12, the outer ends of each piston 600 is provided with a series of compression and sealing rings 620. The illustrated embodiment includes three rings 620 on each end of each piston 600. The rings 620 function to prevent blow-by of the gases from the combustion chamber in each sleeve 300A-F, and also to prevent the leakage of lubricating oil into the combustion chamber.

Each sleeve 300A-F also may be provided with an inner or lower sealing ring 640, as a replacement or supplement for the intermediate piston ring 630. Each ring 640 is mounted at or near the lowest or innermost point on the sleeve 300. This arrangement allows for adequate lubrication between the pistons 600 and the sleeves 300. At the same time, the rings 640 prevent the lubricating oil from flowing inwardly and contaminating the air/fuel chamber 218. The rings 640 likewise prevent the supercharged air/fuel mixture in the chamber 218 from entering the sleeves 300 past the pistons 600, and maintain the proper pressures in the engine during operation.

In addition to or in lieu of the seals 640, each piston 600 may include a set of spaced oil wiper rings 630. As seen in FIGS. 9 and 12, the wiper rings 630 are positioned on the pistons 600 to reciprocate relative to the associated cylinder sleeve 300A-F between the intake port 302 in each sleeve at the top of the piston stroke, and any lower sealing ring 640 in each sleeve at the bottom of each piston stroke. These wiper rings further assist in sealing the oil lubricating system from the combustion gases at the exterior or outer end of each sleeve 300A-F and from the supercharged air/fuel mixture in the chamber 218 at the inner end of each cylinder sleeve. The seal created by the rings 620, 630, furthermore assists in maintaining the necessary pressure in the chamber 218 to assure the proper supercharging of the air/fuel mixture in chamber 218 during the start-up and operation of the engine 100.

Figure 14:
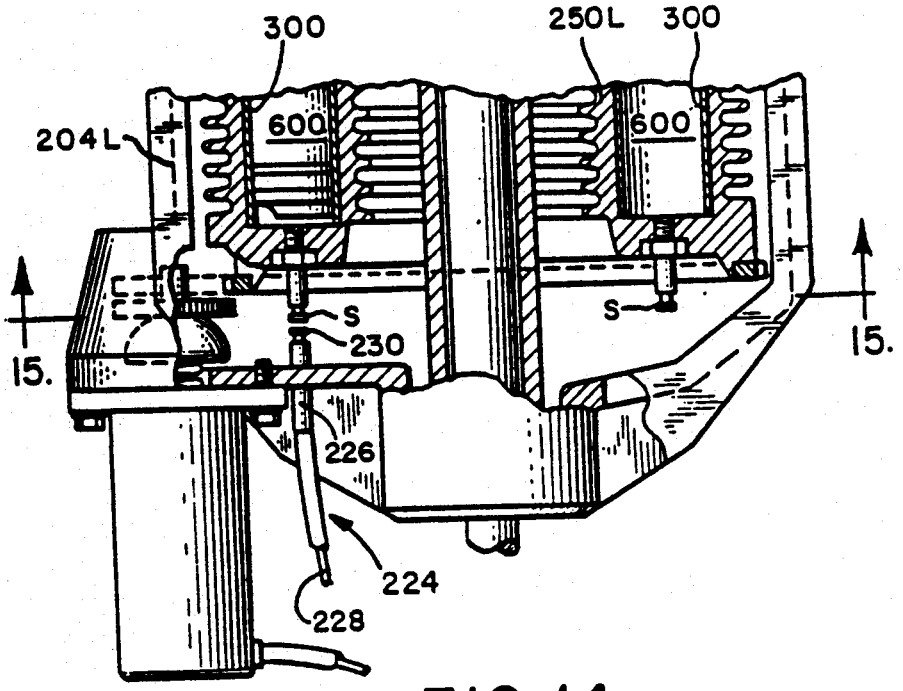
FIG. 14 is a cross-sectional view of the left end of the engine, taken along the line 14—14 in FIG. 15, illustrating the starter system Which can be incorporated into the engine.
Figure 15:
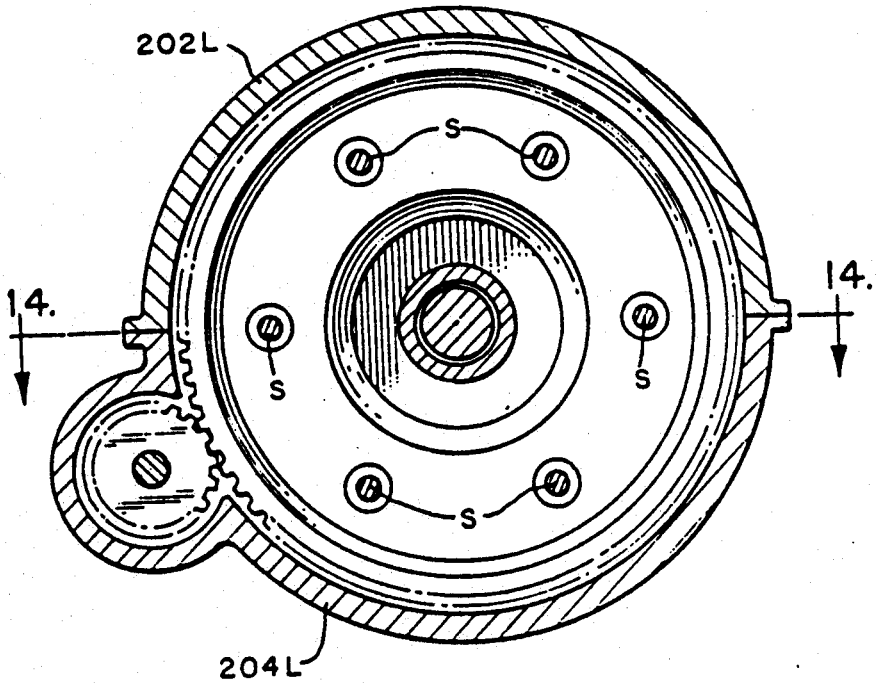
FIG. 15 is a cross-sectional view of the engine starter system taken along the line 15—15 in FIG. 14.

FIGS. 14 and 15 illustrate the ease with which the engine 100 in accordance with this invention can be provided with an electrical starting system. The illustrated starting system includes a conventional solenoid starter motor 550. The housing section 204 can be modified to include a starter housing section 205 which receives the starter motor 550 at one end of the engine 100. The motor 550 includes a standard spring-biased starter gear 552 which is contained within the housing section 205. The starting system further includes a starter ring gear 554 mounted on the adjacent cylinder block 250L for engagement with the starter gear 552. Since the rotating cylinder blocks 250 and 250R have a substantial flywheel effect during operation, the engine 100 does not need a separate flywheel. Accordingly, the ring gear 554 can be an annular gear provided on the cylinder and having a simple and lightweight construction.

The starting of the engine 100 begins by electrically energizing the starter motor 550 in the conventional manner. The starter gear 552 thereby rotates in engagement with the ring gear 554, to impart rotation to the cylinder block 250L. The connection of the cylinder block 250L to the block 250R through the pistons 600 transmits the rotary motion of the block 250L to the block 250R. The ignition system of the engine 100 then fires the spark plugs S at the proper timed interval to begin the power combustion cycle in each cylinder 300A-E. The operation of the engine 100 eventually rotates the cylinder blocks 250L and 250R faster than the rotation of the starter motor 550. At that point, the starter gear 552 withdraws from engagement with the ring gear 554 in the conventional manner. The starting system is thereby repositioned to re-start the engine 100 when needed.

Figure 16:
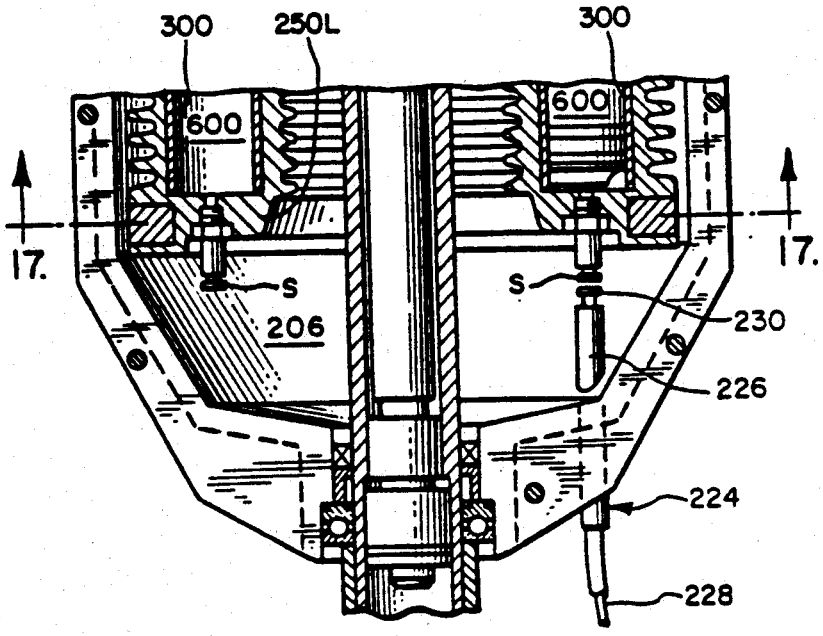
FIG. 16 is a cross-sectional of one end of the engine illustrating the magneto system which can be readily provided to operate the spark ignition of the engine.
Figure 17:
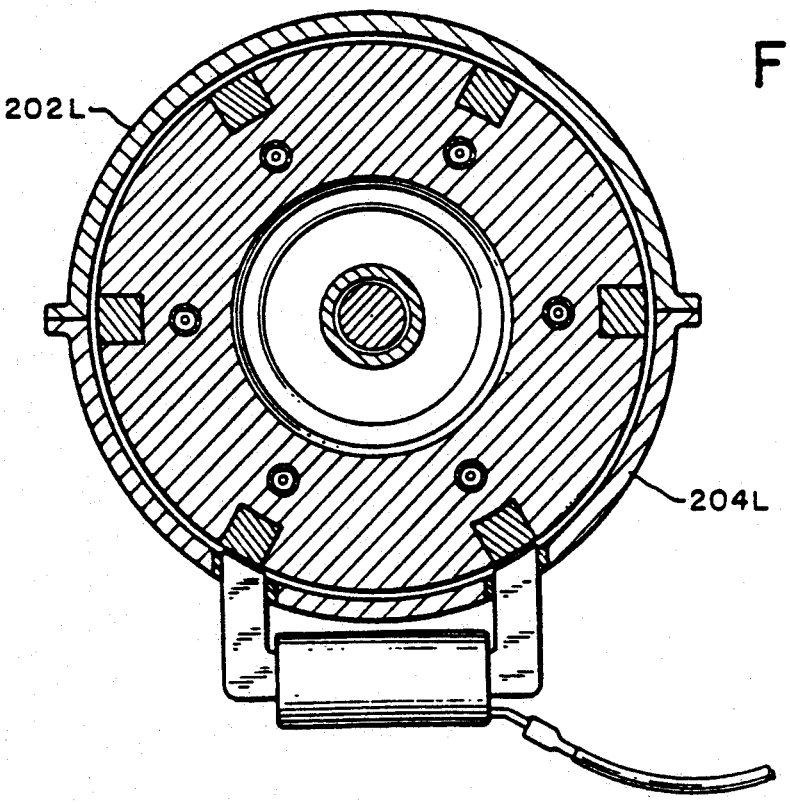
FIG. 17 is a cross-sectional view of the engine taken along the line 17—17 in FIG. 16.

FIGS. 16 and 17 illustrate a magneto ignition system which can be readily incorporated into the engine 100 in accordance with this invention. This magneto system can be separate from or incorporated into the starting system shown in FIGS. 14 and 15 and described above. The magneto system includes a series of six permanent magnets 560 (one for each spark plug S) placed uniformly around the periphery of the cylinder block 250L.

The magneto system also includes a soft iron laminated core 562 mounted on the housing section 204 in alignment with the magnets 560. As seen in FIG. 17, the core 560 defines a pair of pole shoes 564 positioned to be in close proximity to the rotating magnets 560. A winding 566 comprising two high-energy small diameter wire coils is wrapped around the center of the core 562 in the conventional manner. One high energy coil is connected to the spark plug contactor assembly 224 at the left end of the engine, and the other coil is connected to the contactor assembly 224 at the right end of the engine.

The magneto system operates in the conventional manner to energize the spark plugs S at each end of the engine 100. The two plugs S are ignited simultaneously as the associated piston 600 and cylinder 300 more into a position a few degrees of rotation before top-dead-center, at the side 220 of the engine. The rotation of the magnets 560 past the pole shoes 564 creates a collapsing and expanding magnetic flux field in the winding 556. The winding 556 in turn generates a high voltage and low amperage alternating current which is sufficient to jump the gap between the fixed contact points 230 and the plugs to ignite the plugs S at the proper time in the cycle of operation of the engine. The rotation of the plugs S past the fixed contact points 230 eliminates the need for any electrical distributor in the magnetic ignition system.

Figure 19:
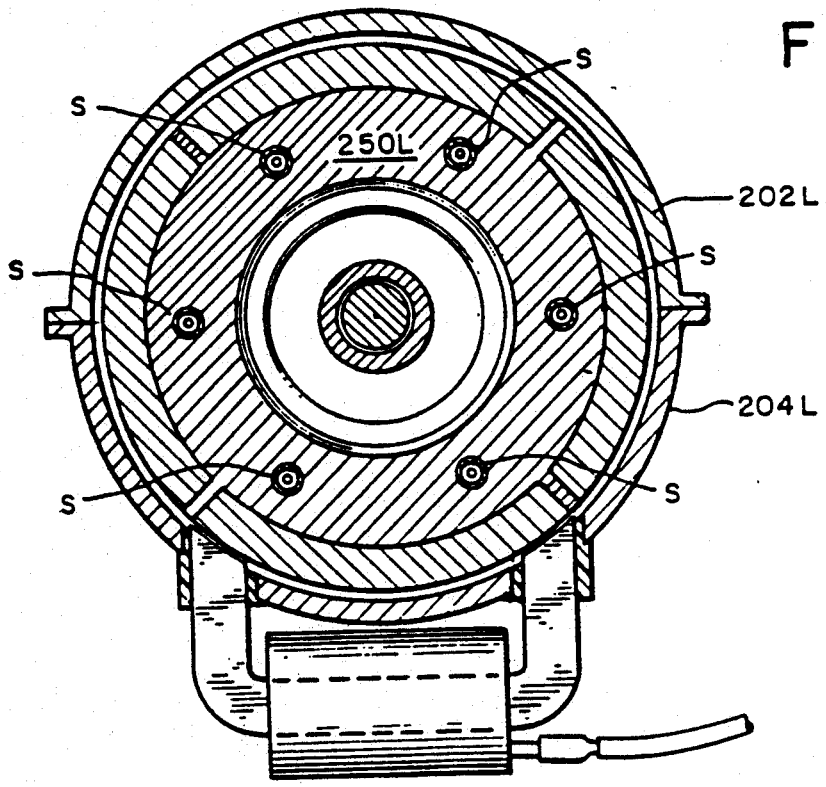
FIG. 19 is a cross-sectional view of the engine taken along the line 19—19 in FIG. 18.

FIGS. 19 and 20 depict a generator system which can be easily added to the engine 100. The generator system can be used in conjunction with a transformer to convert the alternating current to 12 volt DC current to re-charge a battery used in the engine 100. However, the system illustrated in FIGS. 19 and 20 is designed to create electrical energy for auxiliary power.

The generator system includes four arcuate permanent magnets 570 uniformly spaced around the periphery of either one of the cylinder blocks 250L or 250R. A laminated soft iron core 572 is positioned in alignment with the magnets 570 and defines spaced pole shoes 574 in close proximity to the rotating magnets 570. A winding 576 is provided around the center of the core 572. In this embodiment the winding comprises four wire coils so that the generating system can create auxiliary alternating current power, such as 110 volt alternating current at 60 cycles per second, in response to the rotation of the magnets 570 past the pole shoes 574 at a constant selected RPM. A suitable conductor 578 connected to the winding 576 directs this alternating current to an auxiliary unit (not shown) which is to be driven or energized by the generating system provided on the engine 100.

Figure 18:
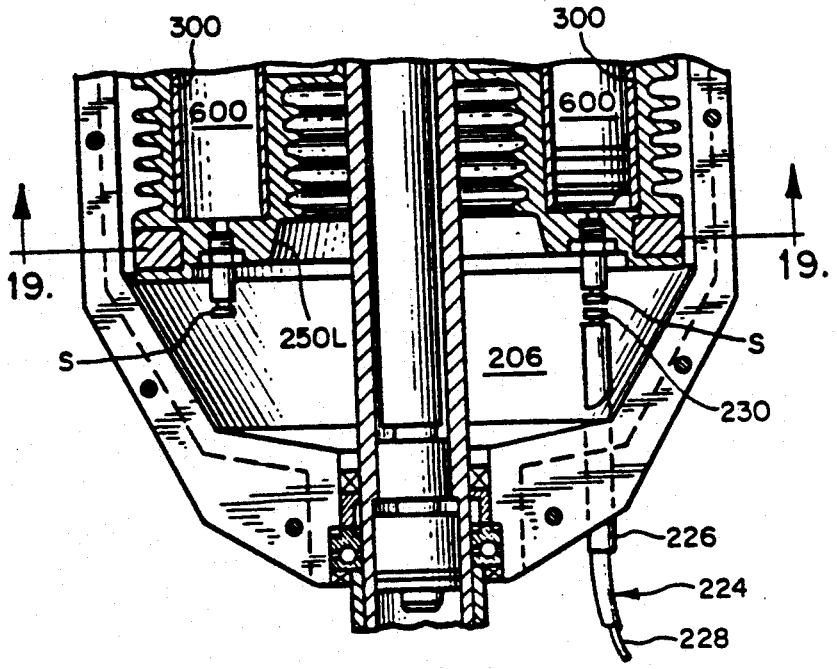
FIG. 18 is a cross-sectional view of one end of the engine illustrating the incorporation of an alternator in the engine for generating electrical power to operate the engine and/or to provide an auxiliary power source.

The generator system shown in FIGS. 18 and 19 can also be combined with a magneto system, such as described above with respect to FIGS. 16 and 17. In a combined magneto and generator system six magents 570 would be used, and a set of pole shoes would be added, adjacent the magnets, with windings appropriately sized to function as a magneto.

Figure 24:
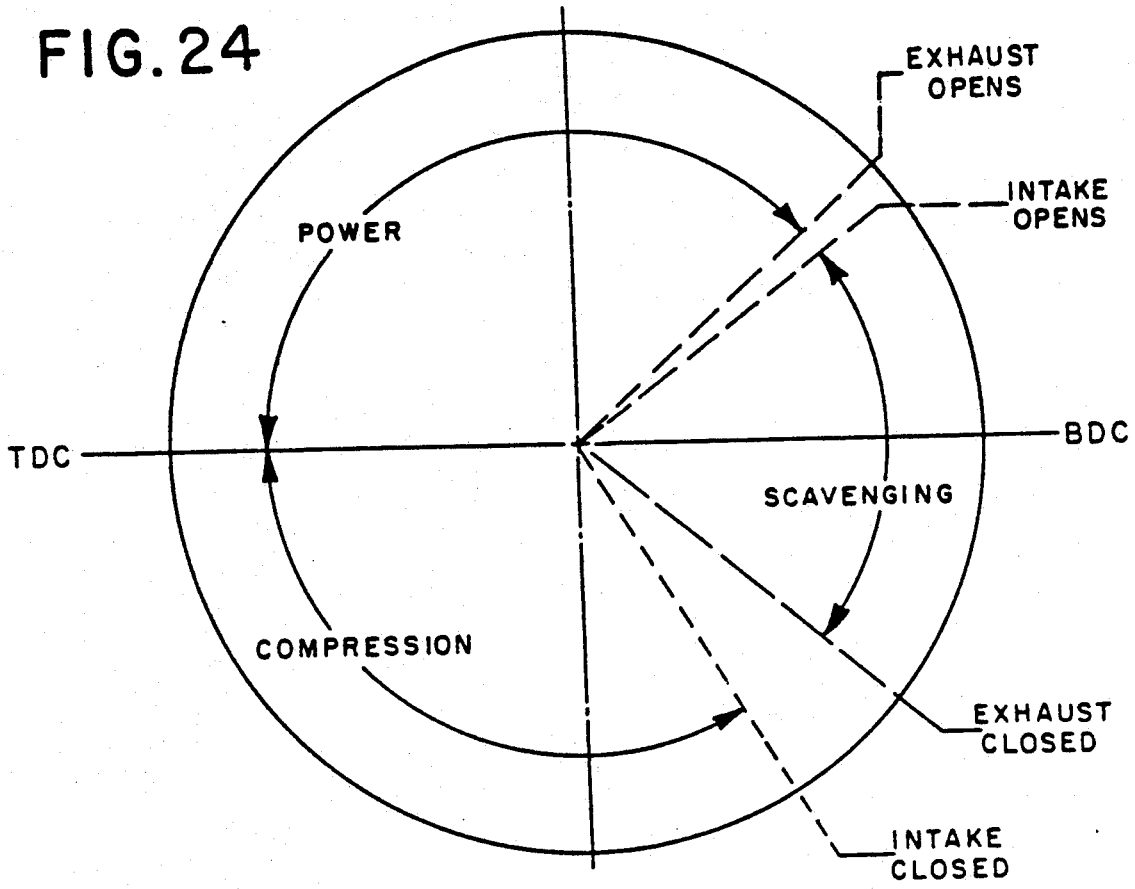
FIG. 24 is a timing diagram relating to the engine, showing the functions of the engine in relation to the rotational position of each piston.

FIG. 24 represents a timing diagram for the rotary vee engine 100 in accordance with this invention. This timing diagram represents the opening of the exhaust ports 302 and the intake ports 304 of each cylinder 300 as the cylinder rotates about the central axis $A_L$ or $A_R$ between a bottom dead center condition (BDC) and a top dead center condition (TDC). As shown in FIG. 24, the components of the engine 100 are arranged so that the exhaust port 302 opens either simultaneously with or slightly in advance of the opening of the intake port 304. In the preferred arrangement, the engine 100 employs the customary arrangement well known in other engine valving systems of opening the exhaust port slightly in advance (within approximately 5° of engine rotation) before the opening of the intake ports 304. As also shown in FIG. 24 the exhaust ports 302 are closed a few degrees (in the range of 5°) before the intake ports are closed. This arrangement allows supercharging of the air/fuel mixture in the cylinders, and enhances the scavenging action in the firing chamber of the cylinders 300 during the operation of the engine 100. The scavenging occurs when the heavier air/fuel gas mixture is discharged radially inwardly into the firing chamber of the cylinders 300 to replace the lighter exhaust gases created by the burning of the previous air/fuel mixture charge in the firing chamber. The exhaust gases exit the cylinder 300 in a radially inward direction. After the intake port 304 is closed, the air/fuel mixture in each cylinder 300 is subjected to a compression stroke until the associated piston 600 reaches top dead center. Slightly before top dead center, as described above, the ignition occurs in the cylinder. As shown in FIG. 24, the power stroke of each cylinder is begun near this top dead center condition and continues with the burning of the air/fuel mixture in the cylinder until the exhaust port opens once again.

Since the engine 100 includes six dual pistons 600 and two cylinder blocks 250L and 250R with the associated six cylinder sleeves 300, the engine 100 thereby defines twelve effective cylinders which can be fired during the operation of the engine. The cylinders are fired in pairs by simultaneously igniting the spark plugs S as the dual piston 600 and associated cylinders 300 approach the top dead center side 220 of the engine. The ignition creates an explosive force on the ends 602 of each pair of pistons 600. Since the pistons 600 are solid in an axial direction, and can rotate within the cylinder sleeves 300, the power stroke of the pistons 600 caused by the ignition of the air/fuel mixture transmits a rotational force to the cylinder blocks 250L, 250R through the cylinder sleeves 300. As the cylinder heads 250L, 250R rotate, the cylinder sleeves 300 rotate relative to the associated piston 600, as the pistons orbit in the cylinder heads about the rotational axis $A_L$, $A_R$. The pistons 600 also reciprocate relative to the cylinder sleeves 300, as the sleeves rotate from a closely associated top dead center position on the top dead center side 220 of the engine to the spaced condition on the bottom dead center side 222 of the engine.

An important aspect of this invention is the utilization of the relative rotary motion between the cylinder sleeves 300 and the associated pistons 600 to provide a rotary valve system to control the timing of the opening and closing of the exhaust ports 302 and the intake ports 304. This rotary valving system, in conjunction with the design and placement of the exhaust ports 302, the intake ports 304, the air/fuel manifolds 280, 284 and the exhaust cavities 270 also function to greatly enhance the effective scavenging action in the firing chambers of the cylinders 300 during the operation of the engine 100.

These engine components are arranged in the engine 100 to overcome the disadvantages of the porting and valving arrangements of prior rotary vee engine designs. These components also utilize the advantageous features of the substantial centrifugal forces imposed upon the intake and exhaust gases during the operation of a rotary vee engine. The undesirable inefficient scavenging and admixture of unburned air/fuel mixture with exhaust gases is overcome by recognizing and designing for the fact that the centrifugal forces in the engine have a greater effect on the heavier air/fuel mixture than on the lighter burned exhaust gases. The engine 100 is designed to accommodate the differential effects of centrifugal force on these gases of different density by an engine design which enhances the scavenging operation by creating a substantial stratification of the unburned and burned gases, instead of a swirling and mixing of the gases, and an improved scavenging effect in the engine cylinders during engine operation.

Figure 26:
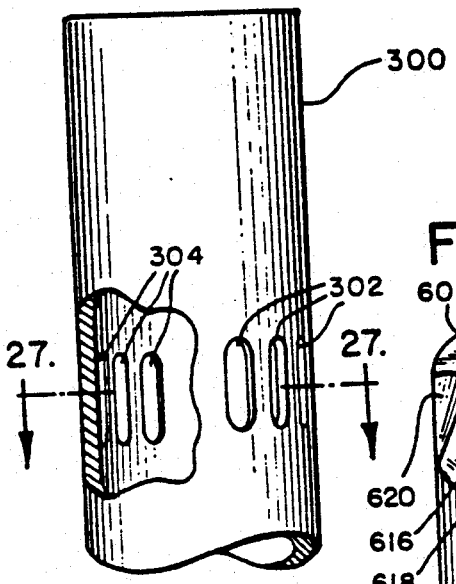
FIG. 26 is a partial plan view of a cylinder sleeve in the engine illustrating the preferred arrangement for the intake and exhaust ports.
Figure 27:
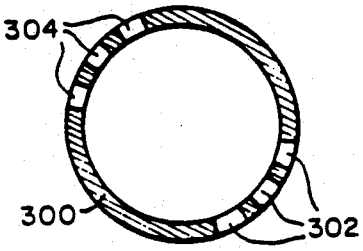
FIG. 27 is a cross-sectional view of the cylinder sleeve taken along the line 27—27 in FIG. 26.
Figure 28C:
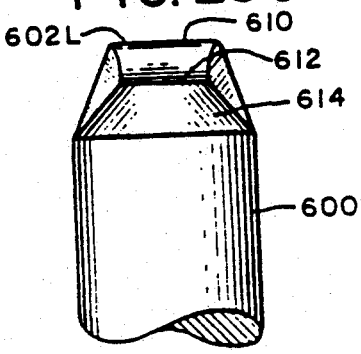
FIG. 28C is a side view of the piston head as viewed along the line 28C—28C in FIG. 28A.
Figure 28D:
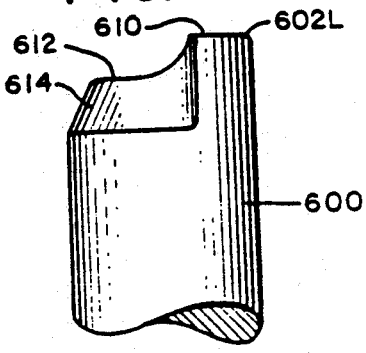
FIG. 28D is a side view of the piston head as viewed along the line 28D—28D in FIG. 28A.
Figure 28E:
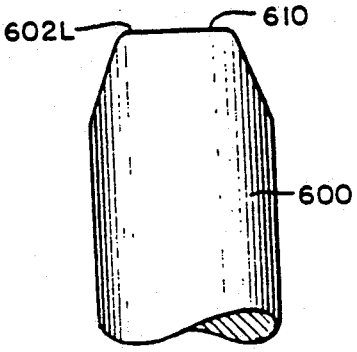
FIG. 28E is a side view of the piston head as viewed along the line 28E—28E in FIG. 28A.

To accomplish this improved engine scavenging, the exhaust ports 302 are provided in each cylinder sleeve 300 in a inwardly radially position centered about a radial line from the axis of rotation $A_L$ or $A_R$ of the engine. Similarly, the intake ports 304 are positioned in the sleeves 300 radially opposite from the exhaust ports 302 on the radially outward portion of the cylinder sleeves 300. The intake ports 304 are also centered about a radial line drawn from the rotational axis $A_L$, $A_R$ of the engine. The exhaust ports 302 can be positioned in the sleeve 300 along substantially the same radial line as the intake ports 304. However, as discussed above it is preferred that the exhaust ports 302 be positioned axially along the sleeves 300 slightly outside of the intake ports 304, so that the exhaust ports open in advance of the intake ports. This slight axially advanced position for the exhaust ports 302 is illustrated in FIG. 26, and the radial arrangement of the exhaust and intake ports is shown in FIG. 27. Each exhaust port 302 and intake port 304 can be a continuous opening in the sleeves 300. As shown in FIG. 26, it is preferred that the exhaust and intake ports comprise a plurality of spaced elongate openings in the sleeves 300. In this manner, the exhaust and intake ports will not interfere with the sliding of the piston rings 620 past the ports as the pistons 600 reciprocate with respect to the sleeve 300.

Figure 28:
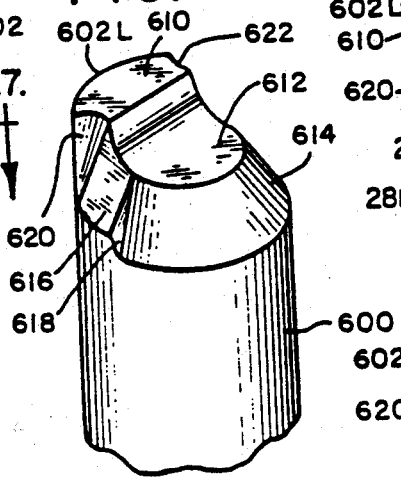
FIG. 28 is a perspective view of the end of the piston illustrating the preferred arrangement for the rotary valving head provided on the end of each piston in accordance with this invention.
Figure 28A:
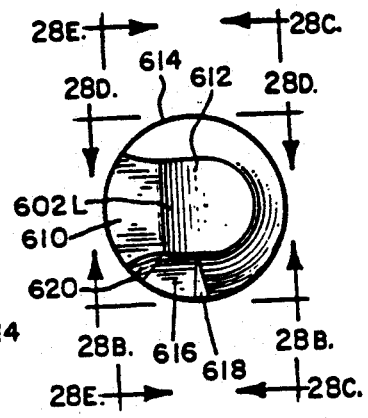
FIG. 28A is a top view of the piston head shown in FIG. 28.
Figure 28B:
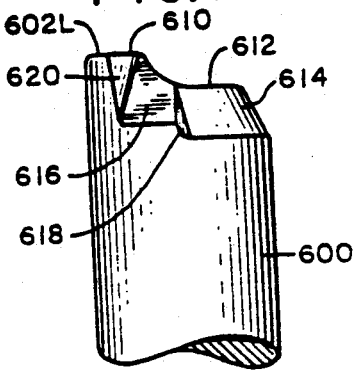
FIG. 28B is a side view of the piston head as viewed along the line 28B—28B in FIG. 28A.
Figure 29A:
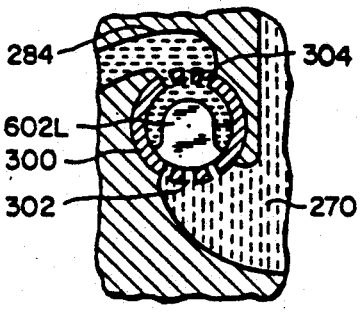
FIG. 29A is a removed partial sectional view of the combustion chamber portion of a cylinder and piston assembly in accordance with this invention shown at the initial stages of the intake and supercharging portion of the engine cycle.
Figure 29A:
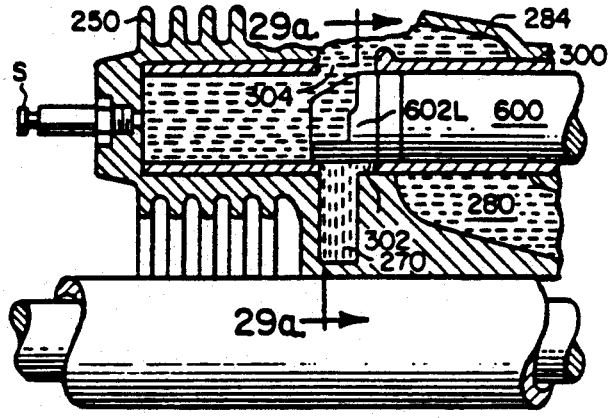

The exhaust ports 302 and intake ports 304 are opened and closed in a programmed manner by the reciprocating and rotary movement of the pistons 600. The piston head 602L, 602R on each piston 600 is configured to define a multi-surfaced rotary valve head which functions to control the opening and closing of the exhaust and intake ports in a programmed manner. A perspective view of this rotary valve defined by the piston head 602 is shown in FIG. 28. FIGS. 28A–E show the various views of this rotary valve head. As seen therein, each piston head 602L, 602R includes a valving lobe 610 which defines the maximum axial length for the piston head. The lobe 610 is coextensive with the periphery of the piston 600 and extends for a selected radial extent of the piston periphery. As seen in FIGS. 29*a* and 29*f*, the radial extent of the lobe 610 is sufficient to close the exhause ports 302 and intake ports 304 as the rotating piston 600 aligns the lobe 610 with the respective ports.

A flat surface valve lobe 612 is machined in the piston head to be spaced a selected axial distance inwardly from or below the lobe 612. As shown in FIGS. 28 and 28A–E, the transition between a lobe 610 and second lobe 612 on the piston head is a smooth arcuate surface. The remaining periphery of the piston head below the surface 612 is machined in a generally conical fashion to define a frustoconical surface 614. This conically shaped surface 614 extends around the periphery of the piston head 602 a selected distance and terminates at the piston portion defining the first lobe 612, as shown in FIG. 28A.

As also shown FIGS. 28, 28A–E, one portion of the surface 614, adjacent the valve lobe 610 is also machined to provide a recessed surface 614 which is connected to the adjacent recessed surface 610 and surface 614 by planar transition surfaces 618 and 620.

The illustrated embodiment for the piston 602L, 602R is suitable for use with the rotary engine having the components arranged as illustrated in the drawings. It will be appreciated by those skilled in the art that the exact dimensions and configuration of the various rotary valve lobes and surfaces 610–620 will depend upon variables such as piston and engine size port placement, desired engine timing, and other factors. Variations can therefore be designed for the rotary valve piston heads 602L, 602R while permitting the piston head to open and close the intake and outlet ports 302, 304 in a programmed manner in response to the relative rotation and reciprocation of the piston 600 in the associated cylinder sleeve 300.

The operation of the piston heads 602L, 602R, and the other components and features of this engine, to control the valving and substantially enhance the scavenging of the engine, will be understood by reference to FIGS. 29*a–i*. These FIGS. 29*a–i* illustrate, in a schematic fashion, the valving and scavenging operations of the engine 100 during a complete operating cycle.

The operation of the engine begins by energizing the starter motor 550 in a conventional manner (see FIG. 14). The starter motor 550 imparts a rotary motion to each cylinder block 250L, 250R. This rotary motion causes the pistons 600 to orbit about the center lines $A_L$, $A_R$ and causes the cylinder sleeves 300 to rotate with respect to the pistons 600. This rotary movement will move each piston 600 between a bottom dead center position, such as shown in FIGS. 29*a* and 29*i*, to a top dead center position as shown in FIG. 29*c*. As this rotation occurs, the carburetor system of the engine continuously provides an air/fuel gas mixture through the intake manifold 201 into the central chamber 218 of the engine. (See FIGS. 1, 4 and 9). The air/fuel mixture will be directed, by pressure and by the rotary motion of the pistons 600 rotating within the chamber 218, into the confined chamber 510 provided in the stuffer block 500. (See FIGS. 7 and 8). The decreased volume and increased velocity of the air/fuel mixture supercharges the mixture in the chamber 510 and maintains the air/fuel mixture in a condition to be charged transversely through the openings 508L, 508R in the stuffer block 500 (see FIGS. 7 and 8) into the air/fuel manifolds 280 of each cylinder block 250L, 250R. The rotary motion of the cylinder blocks 250L, 250R is imparted to the air/fuel mixture in the manifold 280, assisted by the action of the rotating fins 282. The supercharged pressure and the action of centrifugal force on the air/fuel gas mixture forcely drives the mixture radially outwardly into the outer air/fuel chambers 284 (See FIG. 25). As shown in FIG. 29*a*, the air/fuel mixture is thereby maintained in the outer manifold chambers 284 in a supercharged condition, and in position to enter the cylinder 300 through the intake ports 304.

As shown in FIG. 29*a*, the piston heads 602L, 602R on the pistons 600 are rotationally positioned on the pistons so that the lobe 610 is out of alignment, and the conical surface 614 is in radial alignment with the intake port 304 at the bottom dead center condition or side of the engine 100. Similarly, as also shown in FIG. 29*a*, the piston head 602L, 602R is rotationally aligned so that the extended valve lobe 610 on each piston head extends across and closes the exhaust port 302 at this bottom dead center condition. Since the intake ports 304 are positioned on the radial outward surface of the cylinder sleeve 100, the centrifugal force caused by the rotation of the cylinder block will maintain the air/fuel mixture in the outer intake manifold chamber 284. Since the intake port 304 is not closed by the valve lobe 610, the supercharged pressure of the air/fuel mixture in the engine 100 will overcome the centrifugal forces being imparted to the air/fuel mixture and force the mixture by pressure into the outer end of the cylinder sleeve 300.

Figure 29B:
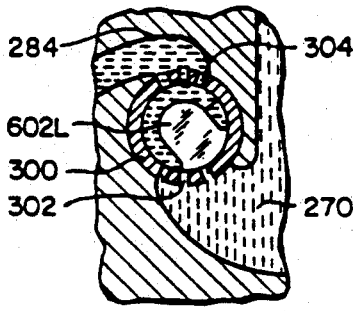
FIG. 29B is a removed partial sectional view of the combustion chamber portion of a cylinder and piston assembly shown at the conclusion of the compression portion of the engine cycle.
Figure 29B:
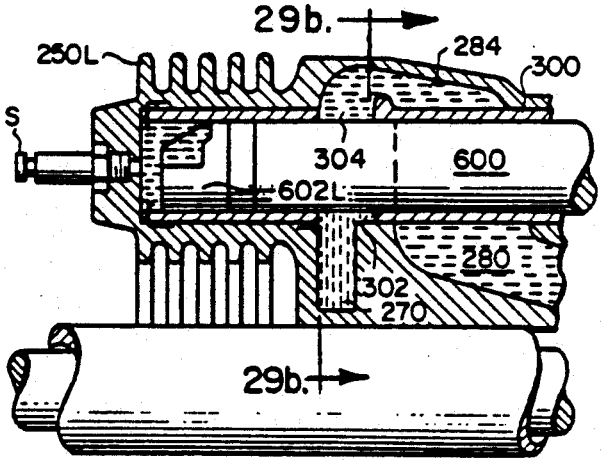
Figure 29C:
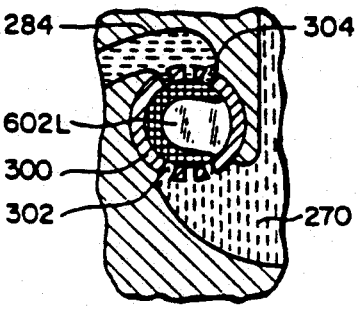
FIG. 29C is a removed partial sectional view of the combustion chamber portion of a cylinder and piston assembly shown at the ignition point of the engine cycle.
Figure 29C:
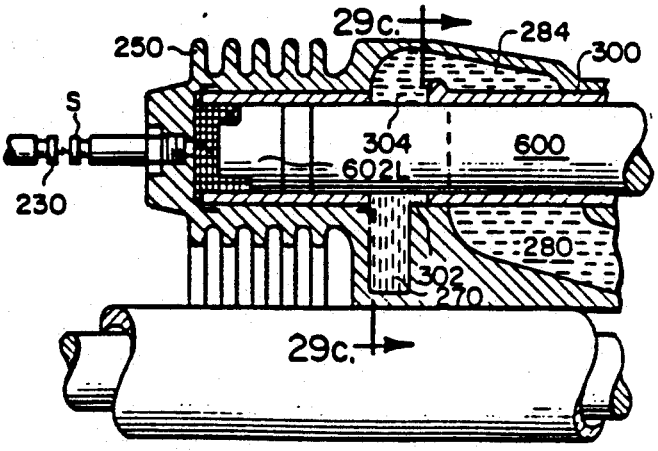
Figure 29D:
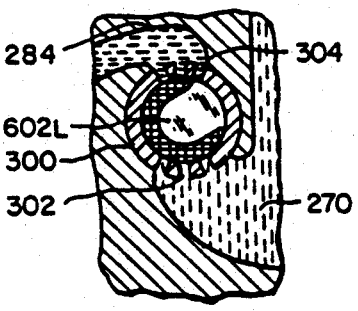
FIG. 29D is a removed partial sectional view of the combustion chamber portion of a cylinder and piston assembly shown during the power stroke of the engine.
Figure 29D:
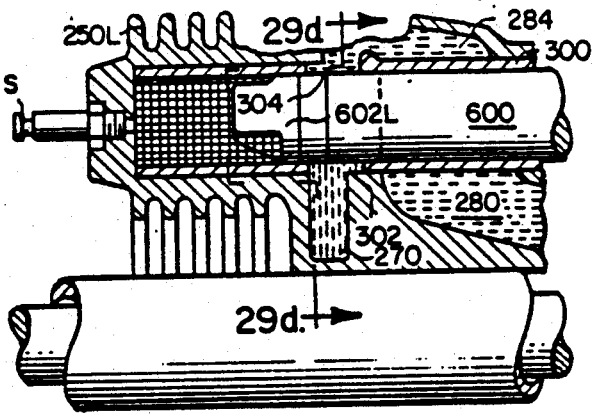

As shown in FIG. 29*b*, the continued rotation and reciprocation of the piston 600 in the sleeve 300 drives the valve surface 614 outwardly past the intake port 304. During this compression stroke of the engine 100, the piston 600 maintains both the intake port 304 and the exhaust 302 closed. This compression stroke continues until the piston reaches the top dead center or ignition position, as shown in FIG. 29*c*. At this point in the cycle, the magneto system of the engine (see FIGS. 16 and 17) fires the spark plug S and ignites the air/fuel charge within the cylinder 300. As shown in FIG. 29*d*, the power stroke of the engine thereby commences, and the piston 600 is driven inwardly relative to the cylinder 300 by the explosive force of the ignited air/fuel mixture. As shown by a comparison of FIGS. 29*a–29d*, the piston head 602 continues to rotate relative to the cylinder 300 during the compression and power strokes.

Figure 29E:
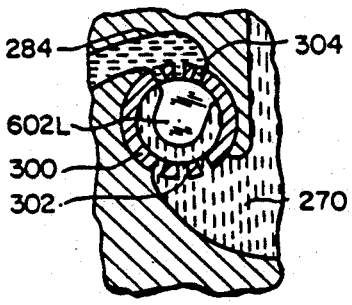
FIG. 29E is a removed partial sectional view of the combustion chamber portion of a cylinder and piston assembly shown during the continuing stages of the power stroke and the initial stages of the exhaust portion of the engine cycle.
Figure 29E:
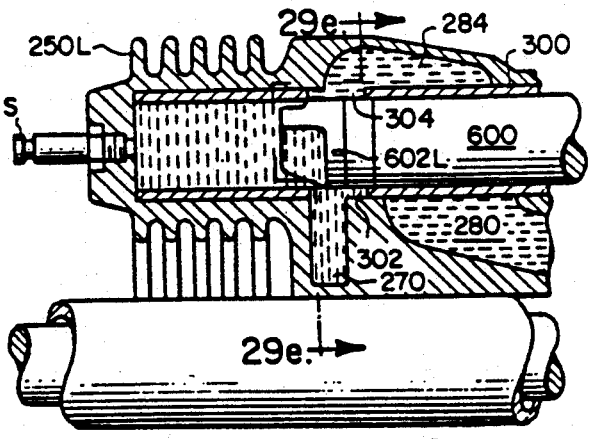
Figure 29F:
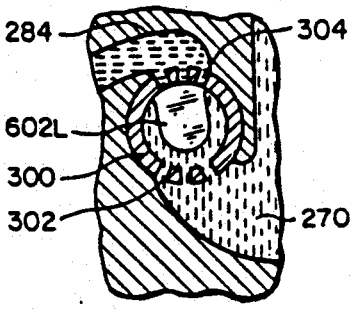
FIG. 29F is a removed partial sectional view of the combustion chamber portion of a cylinder and piston assembly shown during the ending stages of the power stroke and the continuing stages of the exhaust portion of the engine cycle.
Figure 29F:
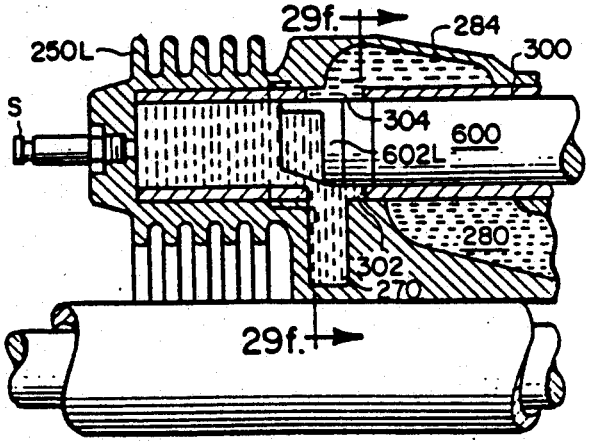

FIG. 29*e* illustrates the termination of the power stroke of the engine 100. At the end of this power stroke, the piston 600 has rotated the piston head 602 in a position so that the valve lobe 610 is clear of the exhaust port, and the surface 614 on the piston head opens the exhaust port 302. As shown in FIG. 29*f*, the conical configuration for the valve surface 614 causes the surface 614 to expand the opening of the exhaust port 302 during the further inward reciprocation of the piston 600. At the same time, the relative rotation of the cylinder sleeve 300 and the piston 600 has caused the valve lobe 610 to rotate into a position to maintain the intake port 302 closed. The exhaust gases are thereby directed through the exhaust ports 302 in a radially inward direction, into the exhaust chambers 270, in opposition to the centrifugal forces applied to the exhaust gases by the rotation of the cylinder blocks 250.

Figure 29G:
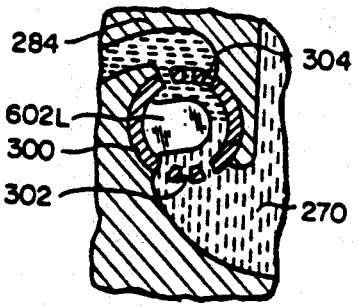
FIG. 29G is a removed partial sectional view of the combustion chamber portion of a cylinder and piston assembly shown during the initial stages of the scavenging portion of the engine cycle.
Figure 29G:
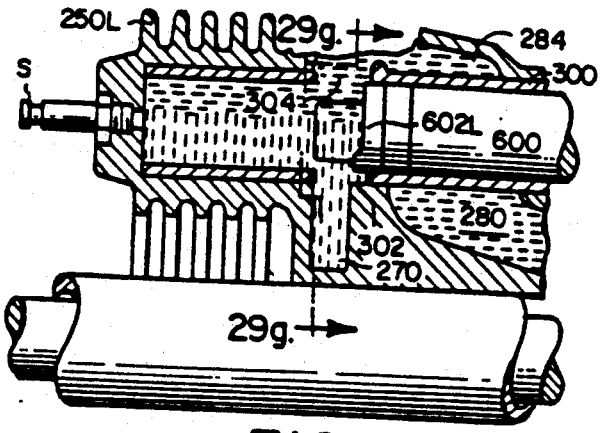

As shown by a comparison of FIGS. 29*f* and 29*g*, the continued rotation of the piston 600 relative to the cylinder 300 (in a counterclockwise direction as shown in FIG. 29*a*), brings the valve surface 616 into communication the exhaust port 302. This groove 616 increases the area through which the exhaust gases can be discharged from the cylinder 300 through the port 302 and into the exhaust chamber 270. At the same time, the valve lobe 610 has rotated partially past the intake port 304 so that the portion of the conical valve surface 614 is in alignment with the intake port 304. In this condition, the intake port is partially opened and the heavier air/fuel mixture is forced into the radially outward portion of the cylinder 300 by supercharged pressure imparted on the air/fuel mixture Since the air/fuel mixture is heavier than the burned exhaust gases, the centrifugal forces created by the rotation of the cylinder block 250 will tend to maintain the air/fuel mixture on the radially outward portion of the cylinder Likewise, the lighter exhaust gases are forced by this heavier air/fuel mixture into the radially inward portion of the cylinder. Thus, as illustrated schematically in FIG. 29*g*, the engine 100 takes advantage of the centrifugal forces to stratify the air/fuel mixture and the exhaust gases so that the heavier air fuel mixture effectively scavenges the exhaust gases out of the cylinder 300.

Figure 29H:
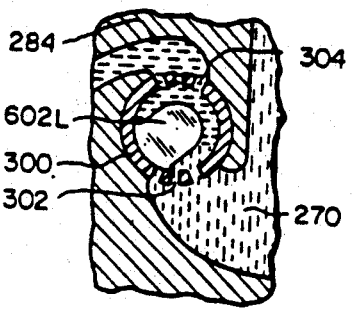
FIG. 29H is a removed partial sectional view of the combustion chamber portion of a cylinder and piston assembly showing the final stages of the scavenging portion of the engine cycle.
Figure 29H:
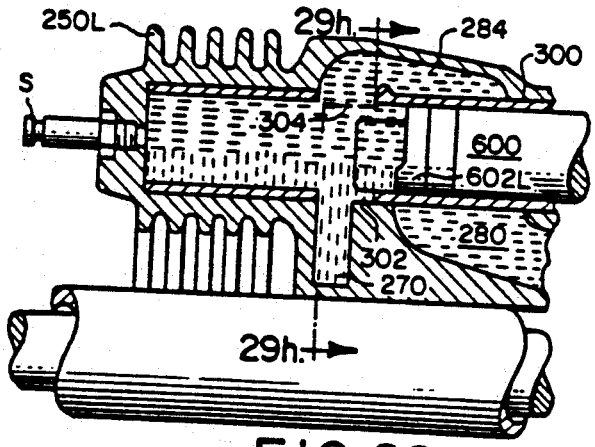
Figure 29I:
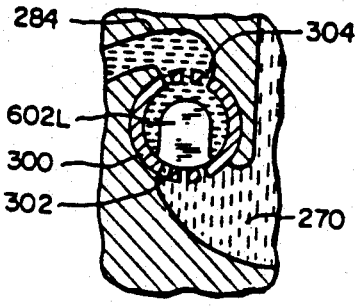
FIG. 29I is a removed partial sectional view of the combustion chamber portion of a cylinder and piston assembly showing the return of the engine to the intake and supercharging portion of the engine cycle, as shown in FIG. 29A.
Figure 29I:
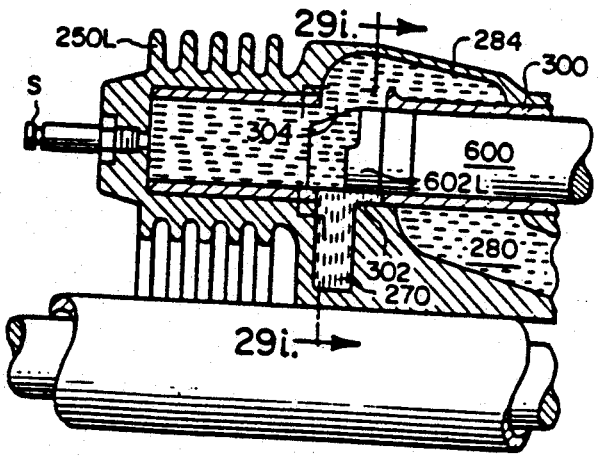

As shown in FIG. 29*h*, the continued rotation of the piston 600 maintains the intake port 304 open, while the valve surfaces 614 and 616 maintain the exhaust port 302 opened. Further scavenging of the exhaust gases out of the cylinder 300 is thereby caused by the continued addition of the heavier air/fuel mixture into the cylinder 300. The air/fuel mixture thus assists in forcing the exhaust gases radially inwardly, against the operation of centrifugal force, into the exhaust chamber 270. As shown in FIG. 29*i*, the scavenging continues until all of the burned exhaust gases are removed form the cylinder 300. In this condition, similar to the condition shown in FIG. 29*a*, the surface 614 is in alignment to maintain the intake port in a fully opened condition. Similarly, the rotary valve lobe 610 has rotated into a position to close the exhaust 302.

This operation occurs simultaneously at the dual ends 602L, 602R of each piston 600. The operation of the engine 100 in the foregoing manner substantially enhances the scavenging of the exhaust gases from the engine by utilizing the centrifugal forces in the engine to create a stratification and scavenging effect instead of causing the air/fuel mixture and exhaust gases to swirl and mix inefficiently in the cylinders 300. The operational efficiency of the engine 100 is thereby substantially improved.

The foregoing description of an illustrated embodiment of this invention is set forth by way of example. It will be appreciated by those skilled in the art that various modifications can be made to the arrangement and components of the engine parts without departing from the scope and spirit of this invention, as set forth in the accompanying claims.

What is claimed is:

1. In a rotary vee engine:

a housing having outer ends;

two cylinder blocks each having inner and outer ends and mounted in the housing for rotation of one cylinder block about a first rotational axis and rotation of the other cylinder block about a second rotational axis, said axes being angled to intersect adjacent the inner ends of said blocks at an included angle less than one hundred and eighty degrees;

each cylinder block having a plurality of cylinders positioned at a selected radial distance from the respective rotational axis and extending parallel to the axis to intersect the inner end of the cylinder block;

a plurality of angled pistons each having a portion disposed in a cylinder of one block and a portion disposed in a cylinder in the other block for orbital motion of the pistons coordinately with the rotation of the cylinder blocks;

angled support shaft means for rotatably and axially supporting each of the cylinder blocks in the housing;

an improved air/fuel system for directing pressurized charges of air/fuel mixture radially inwardly into each of the cylinders during the operation of the engine comprising;

a central cavity formed by the housing between the inner ends of the cylinder blocks for receiving air/fuel mixture;

stuffer block means affixed to the central portion of the support shaft means within the central cavity of the housing and configured to occupy substantially the entire space between the inner ends of the cylinder blocks within the pistons and confined by the housing to define a compressor section which compresses the air/fuel mixture;

air/fuel passage means formed in the stuffer block means to receive air/fuel mixture from the central cavity and redirect the compressed mixture axially toward the cylinder blocks;

air/fuel manifold means defined within the inner end of each cylinder block including an axial portion in fluid communication with the stuffer block passage means to receive air/fuel mixture into the manifold as the cylinders rotate with respect to the stuffer block means;

the manifold means further including a plurality of axially and radially extending manifold passageways each of which terminates in an air/fuel intake chamber positioned at the radial outward side of one of the cylinders, with each manifold passageway configured to direct air/fuel mixture radially outwardly into the associated intake chamber by the pressure of the compressed mixture and by the centrifugal force continuously applied to the mixture as the cylinders rotate during the operation of the engine; and intake port means in the radial outward portion of each cylinder in fluid communication with the adjacent intake chamber and arranged to direct air/fuel mixture radially inwardly into the cylinder from the intake chamber;

the air/fuel system operating to charge air/ fuel mixture radially inwardly into the cylinders without substantial turbulence by creating a compressed mixture pressure sufficient to overcome the centrifugal force continuously applied to the mixture by the rotation of the cylinders during the operation of the engine.

2. A rotary vee engine in accordance with claim 1 wherein the air/fuel manifold means includes fluid impeller means which rotate with the cylinders and impart additional radial velocity and pressure to the air/fuel mixture being directed radially into the intake chambers.

3. A rotary vee engine in accordance with claim 2 wherein each manifold passageway includes a fluid impeller means.

4. A rotary vee engine in accordance with claim 1 wherein the intake port means on each cylinder is centered on the radial extending from the related rotational axis through the center of the cylinder.

5. A rotary vee engine in accordance with claim 4 wherein each intake chamber extends a selected degree around the cylinder and is centered radially outwardly of the adjacent intake port means.

6. A rotary vee engine in accordance with claim 5 wherein each intake port means comprises a plurality of elongate slots extending axially along the adjacent cylinder within the associated intake chamber.

7. In a rotary vee engine:

a housing having outer ends;

two cylinder blocks each having inner and outer ends and mounted in the housing for rotation of one cylinder block about a first rotational axis and rotation of the other cylinder block about a second rotational axis, said axes being angled to intersect adjacent the inner ends of said blocks at an included angle less than one hundred and eighty degrees;

each cylinder block having a plurality of cylinders positioned at a selected radial distance from the respective rotational axis and extending parallel to the axis to intersect the inner end of the cylinder block;

a plurality of angled pistons each having a portion disposed in a cylinder of one block and a portion disposed in a cylinder in the other block for orbital motion of the pistons and rotation of the cylinders with respect to the pistons coordinately with the rotation of the cylinder blocks;

angled support shaft means for rotatably and axially supporting each of the cylinder blocks in the housing;

an air/fuel system for directing pressurized charges of air/fuel mixture radially inwardly into each of the cylinders during the operation of the engine comprising:

a central cavity formed by the housing between the inner ends of the cylinder blocks for receiving air/fuel mixture;

means within the central cavity of the housing adapted to compress and redirect the mixture axially toward the cylinder blocks;

air/fuel manifold means defined within each cylinder block including an axial portion in fluid communication with the central cavity to receive air/fuel mixture into the manifold as the cylinders rotate;

the manifold means further including a plurality of axially and radially extending manifold passageways each of which terminates in an air/fuel intake chamber positioned at the radial outward side of one of the cylinders, with each manifold passageway configured to direct air/fuel mixture radially outwardly into the associated intake chamber by the pressure of the compressed mixture and by the centrifugal force continuously applied to the mixture as the cylinders rotate during the operation of the engine;

intake port means in the radial outward portion of each cylinder in fluid communication with the adjacent intake chamber and arranged to direct air/fuel mixture radially inwardly into the cylinder from the intake chamber by the pressure of the mixture overcoming the centrifugal force applied to the mixture; and an exhaust system for directing the exhaust gases radially inwardly from each cylinder during the operation of the engine comprising:

exhaust port means in each cylinder positioned radially inwardly from the intake port means;

an exhaust manifold defined in the cylinder blocks for each cylinder including an exhaust chamber positioned on the radial inward side of each exhaust port to receive the exhaust gases directed radially inwardly from the associated cylinder and further including an arcuate portion terminating in an exhaust opening in the periphery of the cylinder block and adapted to redirect the exhaust gases in a radially outward direction through the exhaust opening; and an exhaust cavity defined by the housing to receive the exhaust gases discharged from the cylinder block exhaust openings and discharge the exhaust gases from the engine;

the air/fuel system operating to charge relatively dense air/fuel mixture radially inwardly into the cylinders without substantial turbulence and the exhaust system operates to discharge the relatively light exhaust gases radially inwardly from the cylinders, whereby the centrifugal forces stratifies the relatively heavy air/fuel mixture and relatively light exhaust gases in the cylinders to substantially enhance the scavenging of the exhaust gases from the cylinders.

8. A rotary vee engine in accordance with claim 7 wherein the arcuate portion of each exhaust manifold expands in volume toward opening in the periphery of the associated cylinder block and facilitates the discharge of the exhaust gases from the cylinders.

9. A rotary vee engine in accordance with claim 7 wherein the exhaust port means on each cylinder is centered on the radial extending from the related rotational axis through the center of the cylinder.

10. A rotary vee engine in accordance with claim 9 wherein each exhaust chamber extends a selected degree around the cylinder and is centered radially inwardly of the adjacent exhaust port means.

11. A rotary vee engine in accordance with claim 10 wherein each exhaust port means comprises a plurality of elongate slots extending axially along the adjacent cylinder within the associated exhaust chamber.

12. A rotary vee engine in accordance with claim 7 wherein the intake and exhaust port means are located in a selected axial position in each cylinder and each piston includes rotary valve means operative in response to the axial reciprocation of the piston and the rotation of the cylinder with respect to the piston to open and close the intake and exhaust port means in a selected sequential relationship during the operation of the engine.

13. A rotary vee engine in accordance with claim 12 wherein the exhaust port means is positioned in each cylinder with respect to the intake port means so that the rotary valve means opens the exhaust port means a selected degree of engine rotation in advance of the opening of the intake port means.

14. A rotary vee engine in accordance with claim 13 wherein the exhaust port means are further positioned with respect to the intake port means so that the rotary valve means closes the exhaust means a selected degree of engine rotation in advance of the closing of the intake port means.

15. A rotary vee engine in accordance with claim 12 wherein the valving means is defined by the outer piston head portion of each piston.

* * * * *